US010697197B2

(12) United States Patent
Mitchell

(10) Patent No.: US 10,697,197 B2
(45) Date of Patent: Jun. 30, 2020

(54) FENCE SYSTEM

(71) Applicant: Martyn L. R. Mitchell, Milton (CA)

(72) Inventor: Martyn L. R. Mitchell, Milton (CA)

( * ) Notice: Subject to any disclaimer, the term of this patent is extended or adjusted under 35 U.S.C. 154(b) by 532 days.

(21) Appl. No.: 15/542,240

(22) PCT Filed: Jan. 8, 2016

(86) PCT No.: PCT/CA2016/050015
§ 371 (c)(1),
(2) Date: Jul. 7, 2017

(87) PCT Pub. No.: WO2016/109898
PCT Pub. Date: Jul. 14, 2016

(65) Prior Publication Data

US 2018/0002947 A1 Jan. 4, 2018

Related U.S. Application Data

(60) Provisional application No. 62/101,656, filed on Jan. 9, 2015.

(51) Int. Cl.
*E04H 17/14* (2006.01)
*E04H 17/20* (2006.01)

(52) U.S. Cl.
CPC ..... *E04H 17/1413* (2013.01); *E04H 17/20* (2013.01); *E04H 2017/1465* (2013.01); *E04H 2017/1473* (2013.01); *E04H 2017/1491* (2013.01); *E04H 2017/1495* (2013.01)

(58) Field of Classification Search
CPC .... E04H 2017/1452; E04H 2017/1465; E04H 2017/1473; E04H 2017/1478; E04H 2017/1491; E04H 2017/1495; E04H 17/1413; E04H 17/1421; E04H 17/20; E04H 17/22; E04F 11/1834
USPC ..... 256/68
See application file for complete search history.

(56) References Cited

U.S. PATENT DOCUMENTS

| | | | | |
|---|---|---|---|---|
| 799,595 A | | 9/1905 | Drewke | |
| 917,083 A | | 4/1909 | Kyle | |
| 3,820,909 A | * | 6/1974 | Schindler | E04H 17/1413 403/205 |
| 4,260,138 A | | 4/1981 | Freer | |
| 4,702,459 A | | 10/1987 | Moschner | |
| 5,168,678 A | | 12/1992 | Scott, Jr. et al. | |

(Continued)

FOREIGN PATENT DOCUMENTS

WO 2016/109898 A1 7/2016

OTHER PUBLICATIONS

International Search Report and Written Opinion dated Mar. 23, 2016 in respect of International Application No. PCT/CA2016/050015.

*Primary Examiner* — Matthew R McMahon
(74) *Attorney, Agent, or Firm* — Bereskin & Parr LLP/S.E.N.C.R.L., s.r.l.

(57) ABSTRACT

A fence system includes posts, links and fasteners. Once assembled, the fasteners extend through holes of the posts, and each of the fasteners can couple a first end of a first one of the links to a second end of a second one of the links to secure the links to the respective post. Each of the fasteners can apply a clamping force that urges the second end of the second one of the links towards the respective post to bear against the first end of the first one of the links.

19 Claims, 22 Drawing Sheets

(56) References Cited

U.S. PATENT DOCUMENTS

| | | | | |
|---|---|---|---|---|
| 5,575,580 | A * | 11/1996 | Parrish | E04H 17/1413 403/49 |
| 5,653,546 | A | 8/1997 | Cronkhite et al. | |
| 5,785,447 | A * | 7/1998 | Fonti | E04H 17/1413 403/49 |
| 6,575,652 | B2 * | 6/2003 | Krauss | F16D 1/087 403/49 |
| 9,637,931 | B2 * | 5/2017 | Hart | E04F 11/1817 |
| 9,885,197 | B2 * | 2/2018 | Pettlon, II | E04F 11/18 |
| 2008/0029748 | A1 * | 2/2008 | Ford | E04H 17/1413 256/65.03 |
| 2015/0252941 | A1 * | 9/2015 | Sirkin | F16L 3/1207 248/72 |
| 2017/0363124 | A1 * | 12/2017 | Brown | E04H 17/16 |

* cited by examiner 96
94

10I
106
10I
10J
10J 88
98
86
84
90
102

104
100
92

102
10H 28
100

110
108

FENCE SYSTEM

CROSS-REFERENCE TO RELATED APPLICATIONS

This is a national stage application of International Application No. PCT/CA2016/050015 filed on Jan. 8, 2016, which claims priority to U.S. Provisional Application No. 62/101,656 filed on Jan. 9, 2015, and the entire contents of each are hereby incorporated herein by reference.

TECHNICAL FIELD

The present disclosure relates to fencing.

BACKGROUND

The following paragraphs are not an admission that anything discussed in them is prior art or part of the knowledge of persons skilled in the art.

Fences exist in many forms and are used for many purposes and in many situations. For example, fences are used in residential settings, industrial settings and rural settings. Many fencing solutions are ideal for their particular market, such as with barbed wire fencing used to contain livestock on a ranch.

Many fencing solutions have inherent limitations, such as the inability to conform to a curving path or to a path that varies in elevation. This results in fences that might lean, have gaps underneath and be limited largely to straight sections of considerable length and with harsh corners.

Traditional fences can be expensive and contain large amounts of materials. They can also be labour intensive to install, often requiring professional installation. Fencing solutions that can follow curves and elevation changes, such as custom formed and welded wrought iron, can be expensive to manufacture and install. Such solutions are thus not an option for many homeowners.

INTRODUCTION

The following paragraphs are intended to introduce the reader to the more detailed description that follows and not to define or limit the claimed subject matter.

The present disclosure relates to a fence system consisting of multiple and repeating components. Such components can include an arrangement of vertical posts secured together with one or more rows of horizontal links. Each link can interface at each of its ends with spherical joints and with a respective post, and these nodes can provide a freedom of movement. This arrangement of joints can create a series of linked parallelograms on the vertical plane, but which can also pivot on an axis orthogonal to the horizontal plane. This can give the fence multiple degrees of freedom while still maintaining its structural integrity and vertical orientation of posts. This can allow the fence to be adjusted to follow contours in plan and to simultaneously follow changes in elevation while allowing all posts to be positioned in a vertical orientation. As such, the fence system of the present disclosure can conform to most any terrain and path. Once the desired position is established, each link can be clamped tight, and friction can maintain the components in a fixed position.

Utilizing fasteners to secure the joints can enable the joint to be loosened or disassembled if required and the fence adjusted or reconfigured. A spring can be beneficial to ensure the node is always clamped tightly and with a predetermined force. This can allow for compliance to dimensional changes caused by factors such as fluctuations in temperature, water absorption and physical creep in materials, which otherwise can cause the clamping pressure to fluctuate and the joint to loosen.

The clamping force can also allow several consecutive links and their posts to be self-supporting and secured in space with these posts not connected to the ground. The clamping can be accomplished via nested and clamped spherical contact surfaces at each end of each link. One end of each link can form a spherical ball or pivot when assembled and the other end can form a clamp. When assembled, each consecutive link clamps on the ball of the previous link. The length of the assembled fence can therefore be unlimited with more or less links as required.

For an open ended fence, the initially installed post can have a pivot ball for each row of links. The pivot ball can be required as the first link does not have previous link with a ball end on which to clamp. The opposite condition exists on the final end of the fence, where there is a ball end of a link but nothing to clamp it. In this case, an end cap can be used on each row to clamp the final link. For a closed loop fence, the pivot balls and end caps are not required as the links can be manipulated such as to close on themselves creating a continuous fence.

The number of rows of horizontal links in the fence is variable, as is their vertical spacing. The length of the horizontal links, and hence the horizontal spacing between the posts, is also variable. The post length is also variable.

The fence system described herein has utility in the residential fencing sector. It is well suited for applications such as, but not limited to, decorative landscape accent, landscape transition delineation, traffic blocking and guidance and keeping pets and children out of gardens or other areas. The fence system can also be applied to other fencing sectors.

The fence system of the present disclosure can be easily and inexpensively manufactured, can contain minimal materials, and can be installed by an individual using, for example, a screwdriver and a hammer. A ten foot length of the subject fence can weigh as little as ten pounds. The components can be well suited for mass production and can be easily and inexpensively produced in high volumes. High part volumes and low part costs can make it possible to produce a fence for a fraction of the cost of fencing traditionally available to homeowners. It can easily be purchased, assembled and installed by the buyer.

Other aspects and features of the teachings disclosed herein will become apparent, to persons skilled in the art, upon review of the following description of the specific examples of the present disclosure.

BRIEF DESCRIPTION OF THE DRAWINGS

The drawings included herewith are for illustrating various examples of apparatuses and methods of the present disclosure and are not intended to limit the scope of what is taught in any way. In the drawings:

FIG. 10 is an orthogonal view of an example of a rear link of the fence system;

FIGS. 10A, 10B, 100 and 10D are projected views of the rear link;

FIGS. 10E, 10F and 10G are perspective views of the rear link;

FIG. 10H is a detail view of FIG. 10;

FIGS. 10I and 10J are cross-sectional views taken from FIG. 10B;

DETAILED DESCRIPTION

Various apparatuses or methods are described below to provide an example of an embodiment of each claimed invention. No embodiment described below limits any claimed invention and any claimed invention may cover apparatuses and methods that differ from those described below. The claimed inventions are not limited to apparatuses and methods having all of the features of any one apparatus or method described below or to features common to multiple or all of the apparatuses or methods described below. It is possible that an apparatus or method described below is not an embodiment of any claimed invention. Any invention disclosed in an apparatus or method described below that is not claimed in this document may be the subject matter of another protective instrument, and the applicant(s), inventor(s) and/or owner(s) do not intend to abandon, disclaim or dedicate to the public any such invention by its disclosure in this document.

Figure 1:
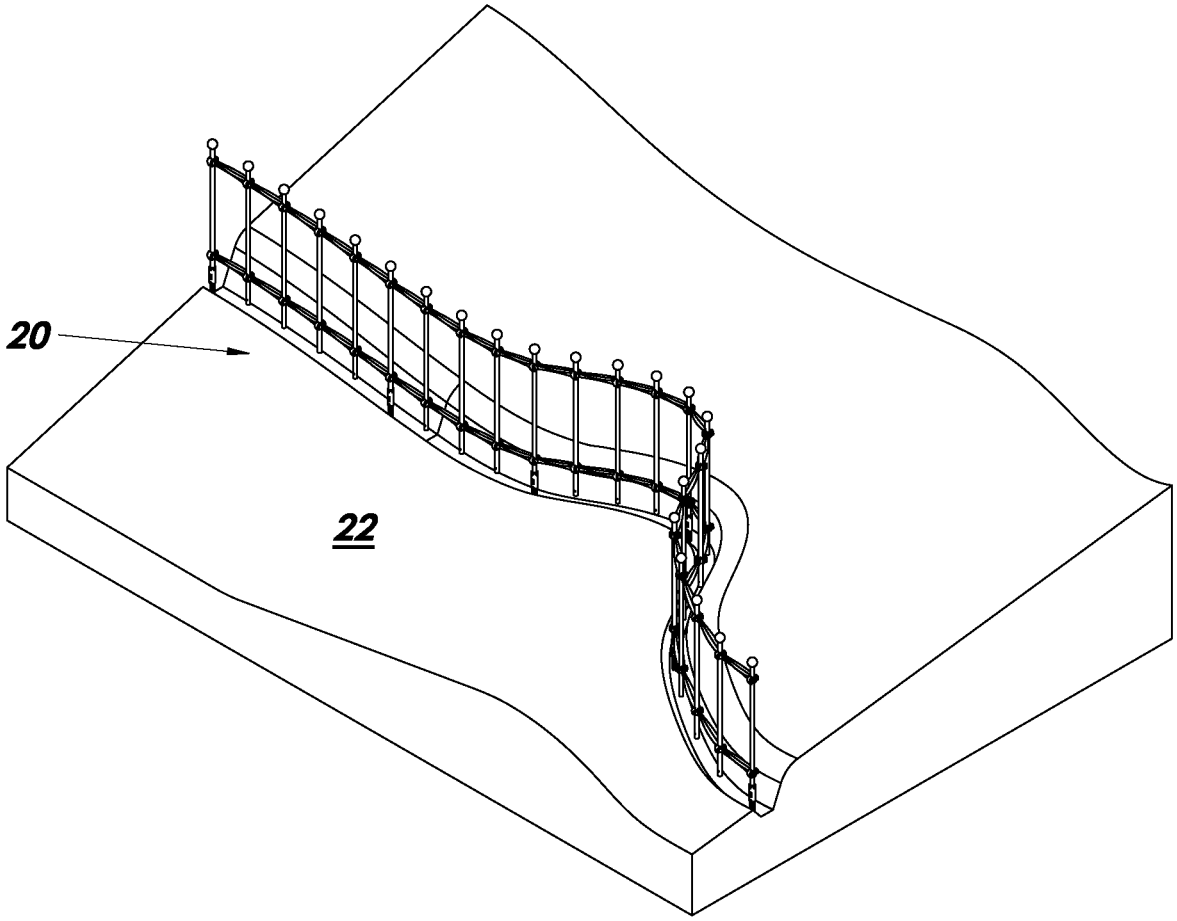
FIGS. 1, 2 and 3 are perspective, plan and front elevation views, respectively, of an example of a fence system.
Figure 2:
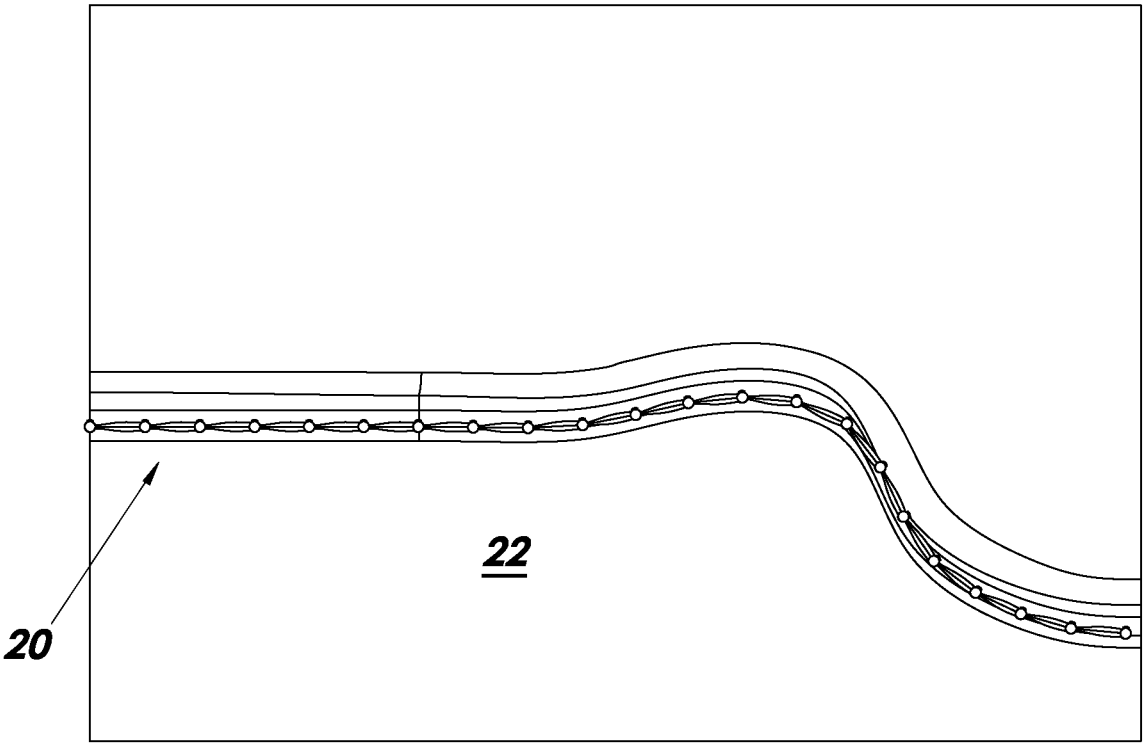
Figure 3:
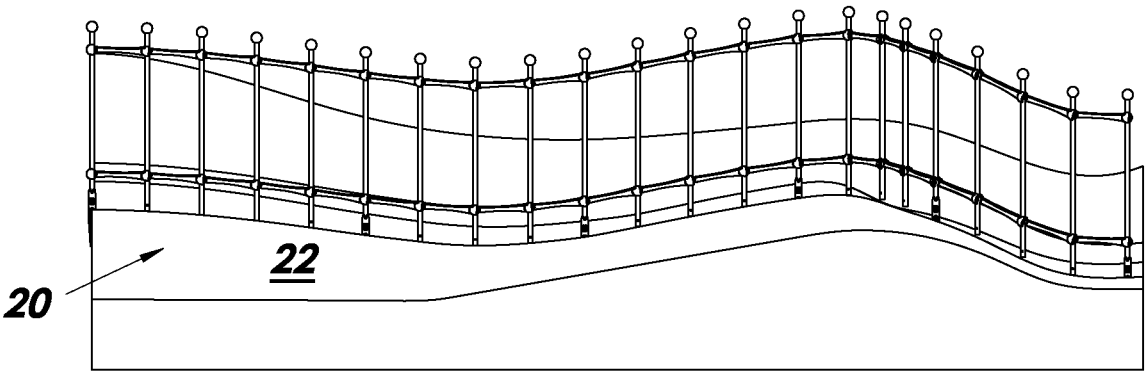

Referring to FIGS. 1, 2 and 3, an example of a fence system is shown generally at reference numeral 20. The fence system 20 is shown assembled and installed on ground surface 22.

Figure 4:
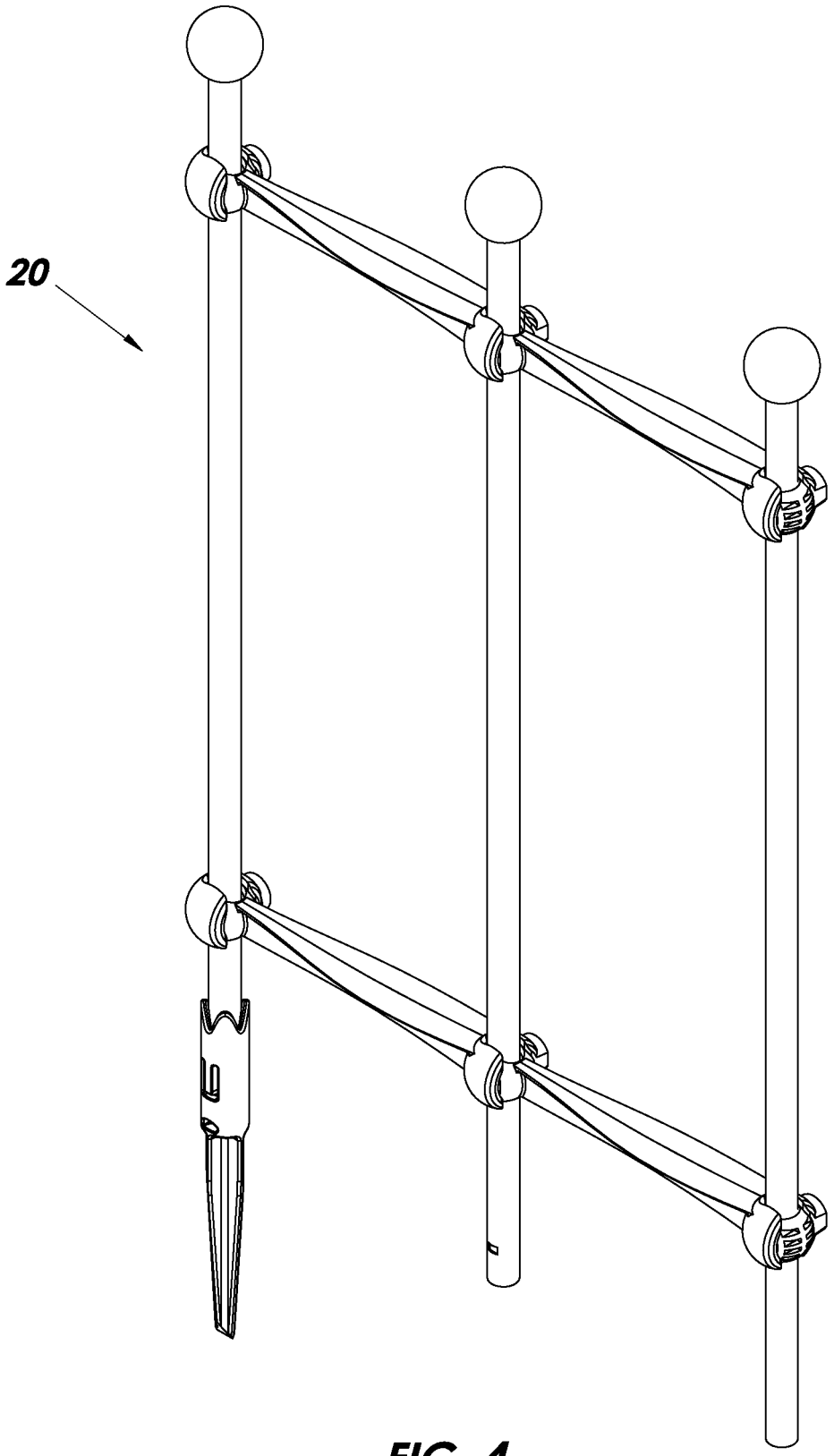
FIGS. 4 and 5 are perspective and partially exploded perspective views, respectively, of a representative portion of the fence system.
Figure 5:
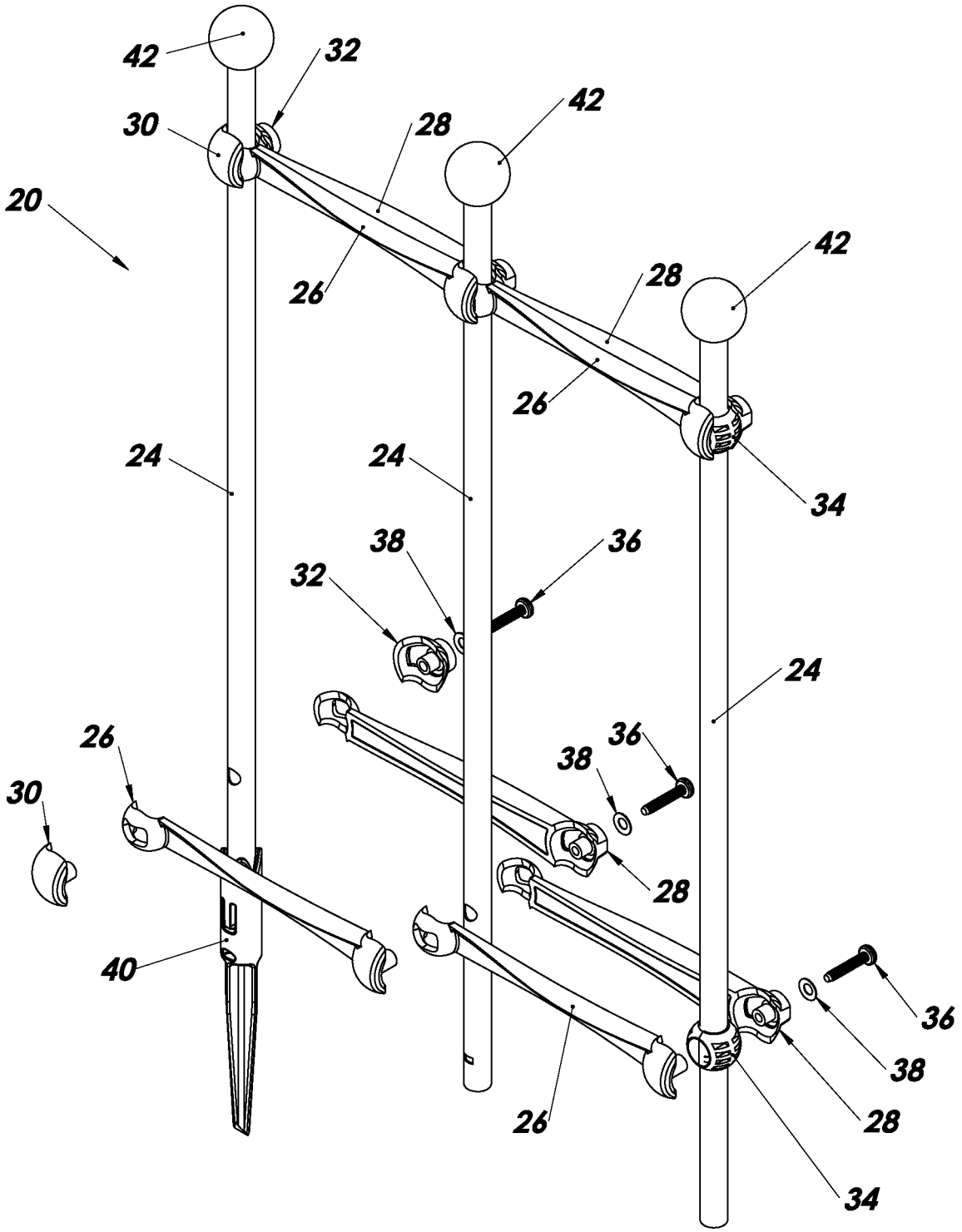
Figure 6A:
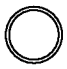
FIGS. 6, 6A and 6C are orthogonal, projected and perspective views, respectively, of an example of a post of the fence system.
Figure 6C:
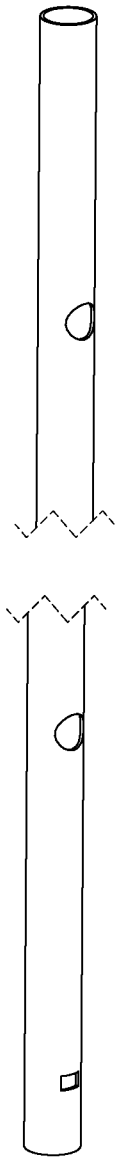
Figure 6:
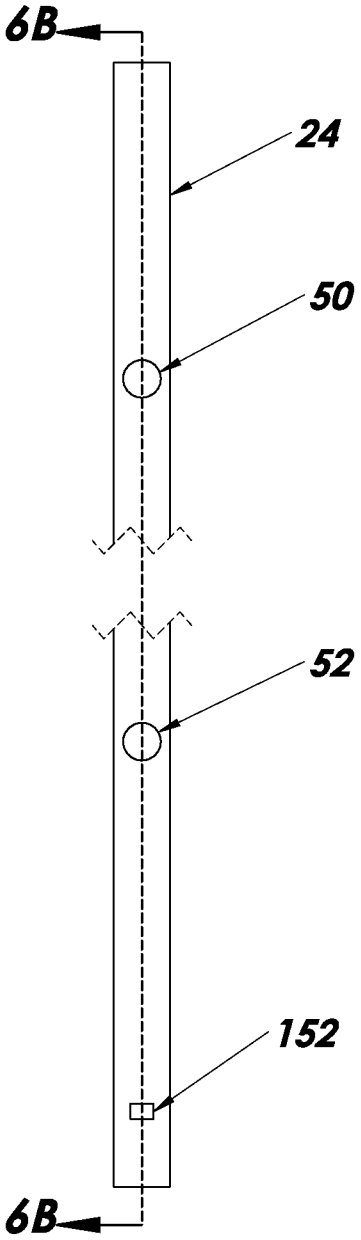
Figure 6B:
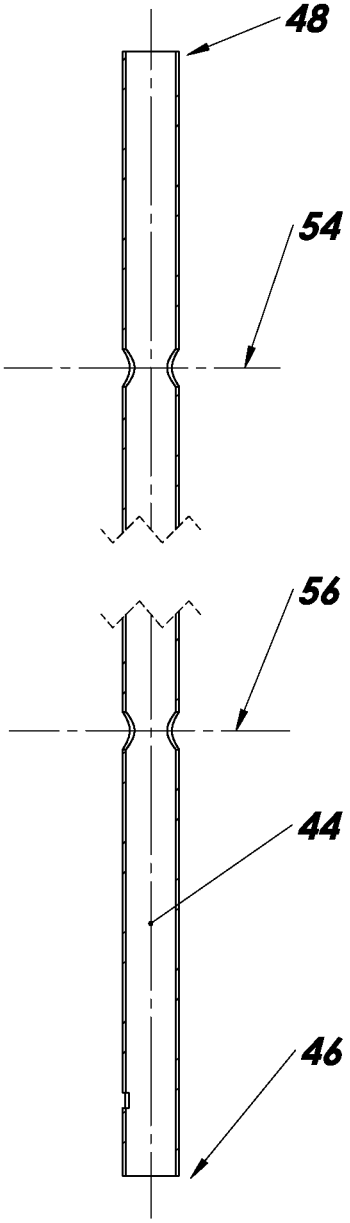
FIG. 6B is a cross-sectional view taken from FIG. 6.

Referring to FIGS. 4 and 5, in the example illustrated, the fence system 20 includes posts 24, front or first links 26, rear or second links 28, front or first end caps 30, rear or second end caps 32, pivot balls 34, stakes 40 and finials 42. Fasteners are used to releasably couple these various components. In the example illustrated, the fasteners include screws 36 and disc springs 38.

Referring to FIGS. 6, 6A, 6B and 6C, the posts 24 can serve as the vertical members of the fence system 20. In the example illustrated, the posts 24 extend lengthwise along a post axis 44 between a first end 46 and a second end 48. The posts 24 are shown to include holes 50, 52, which extend through the post 24 intermediate of the first and second ends 46, 48. Each of the holes 50, 52 define a respective hole axis 54, 56. The axes 54, 56 can be parallel to each other, and each can be arranged to be coplanar with and orthogonal to the post axis 44.

In some examples, the holes 50, 52 can provide for engagement of pin bosses (not yet shown) of the front link 26, the rear link 28, the front end cap 30 and the rear end cap 32, as described in further detail herein. The engagement of the pin bosses can establish and maintain the vertical position of the links 26, 28 relative to the posts 24, and yet the pin bosses can be free to rotate and/or translate within the holes 50, 52 to provide a range of motion for assembly of the links 26, 28 to the posts 24.

In some examples, posts (not shown) can be made that include at least some portion of pin bosses of the front link 26, the rear link 28, the front end cap 30 and/or the rear end cap 32, which can be formed integral therewith. In such examples, the portion of the pin bosses of the front link 26, the rear link 28, the front end cap 30 and/or the rear end cap 32 can be replaced with sockets to accept the pin bosses integral to the molded post.

In the example illustrated, the posts 24 are shown as a round hollow tube with open ends. The finials 42 (see FIG. 5) can serve to cap the top end 48 of the post 24. The finials 42 can prevent water ingress and protect users from injury. It can be of any practical shape, construction or material.

The posts 24 can be formed of a metal tube of steel, aluminum or other suitable material. Other materials can be utilized, such as but not limited to, plastic resin and composite materials, including fibreglass or carbon reinforced resin. Various processes can be utilized for manufacturing the posts 24 including pultruding, extruding, forging and plastic or metal injection molding.

Referring to FIGS. 7, 7A, 7B and 7C, another example of posts 24*a* is shown, in which the post 24*a* is of a molded construction. The post 24*a* extends lengthwise between a first end 46*a* and a second end 48*a*. The post 24*a* is shown to include holes 50*a*, 52*a*, which extend through the post 24*a* intermediate of the first and second ends 46*a*, 48*a*.

Referring to FIGS. 8, 8A, 8B and 8C, another example of posts 24*b* is shown, in which the post 24*b* is of a molded construction containing internal voids. Such internal voids can be produced using gas assisted injection molding or a similar process. The post 24*b* extends lengthwise between a first end 46*b* and a second end 48*b*. The post 24*b* is shown to include holes 50*b*, 52*b*, which extend through the post 24*b* intermediate of the first and second ends 46*b*, 48*b*.

Referring to FIGS. 9, 9A, 9B, 9C, 9D, 9E, 9F, 9G, 9H, 9I and 9J, the front link 26 can serve as one half of each horizontal link between the posts 24 of the fence system 20. The front link 26 has a male or first end 58, and a female or second end 60 spaced apart from the male end 58 along a first link axis 62. Once assembled, the first link axis 62 can be collinear with the hole axis 54 (or the hole axis 56). In the example illustrated, the ends 58, 60 are hemispherical and complementary in shape and size, so that, when assembled, the female end 60 of one front link 26 can generally envelop the male end 58 of the next front link 26 in the repeating chain.

In the example illustrated, the front link 26 includes a pin boss 64 on the female end 60. The male end 58 includes a slot 66 that provides clearance for passage of the pin boss 64 into the holes 50 (or the holes 52) of posts 24. The pin boss 64 can include a bore 68 that is sized appropriately for proper engagement of a thread forming or thread cutting screw, which can eliminate the need to mold or machine threads into the bore 68.

A web 70 joins the ends 58, 60, and can be of any suitable shape. Where the web 70 interfaces with the ends 58, 60, it can be sized to allow maximum travel of the front links 26 without interference, and while maintaining adequate strength characteristics. In the example illustrated, the web 70 includes an inner mating surface 76, which extends substantially between the ends 58, 60.

In the example illustrated, the ends 58, 60 can include respective inner surfaces 72, 74. The inner surfaces 72, 74 can generally abut the posts 24 and can be sized and shaped so that the ends 58, 60 are coupled with the posts 24 in a locational clearance fit. In some examples, the inner surfaces 72, 74 can be sized and shaped to provide nominal clearance to the posts 24 to account for tolerances, and/or to ensure proper mating of surfaces 76, 104 and/or surfaces 78, 80 (described below). In some examples, the inner surfaces 72, 74 can provide clearance so that the front link 26 can be positioned with the first link axis 62 at an angle offset of 90 degrees relative to the post axis 44.

In the example illustrated, an outer side of the first end 58 includes a convex clamping surface 78, and an inner side of the second end 60 includes a concave clamping surface 80 for complementary engagement with the convex clamping surface 78. The surfaces 78, 80 are contact surfaces that can provide for friction when a clamping force is applied. Increasing surface roughness of the surfaces 78, 80 can increase holding power. Surface roughness can be incorporated by texturing the appropriate surfaces in the injection mold for this part.

In the example illustrated, the inner side of the female end 60 includes a contact relief area 82 arranged between the pin boss 64 and the concave clamping surface 80. The contact relief area 82 can provide for the parts to contact each other spaced apart from the spherical center. This can provide for a larger mechanical advantage, such that the friction between the surfaces 78, 80 is maximized and hence the joint can carry more load.

Referring to FIGS. 10, 10A, 10B, 10C, 10D, 10E, 10F, 10G, 10H, 10I and 10J, the rear link 28 can serve as the other half of each horizontal link between the posts 24. The rear link 28 has a male or first end 84, and a female or second end 86 spaced apart from the male end 84 along a second link axis 88. Once assembled, the second link axis 88 can be generally collinear with the first link axis 62 and the hole axis 54 (or the hole axis 56). In the example illustrated, the ends 84, 86 are hemispherical and complementary in shape and size, so that, when assembled, the female end 86 of one rear link 28 can generally envelop the male end 84 of the next rear link 28 in the repeating chain.

In the example illustrated, the rear link 28 includes a pin boss 90 on the female end 86. The male end 84 includes a slot 92 that provides clearance for passage of the pin boss 90 into the holes 50 (or the holes 52) of the posts 24. The pin boss 90 can include a through bore 94 that is sized appropriately for proper clearance of the screws 36. The female end 86 is also shown to include a recess 96 for seating the disc springs 38, which can be concentric with the through bore 94.

Figure 15:
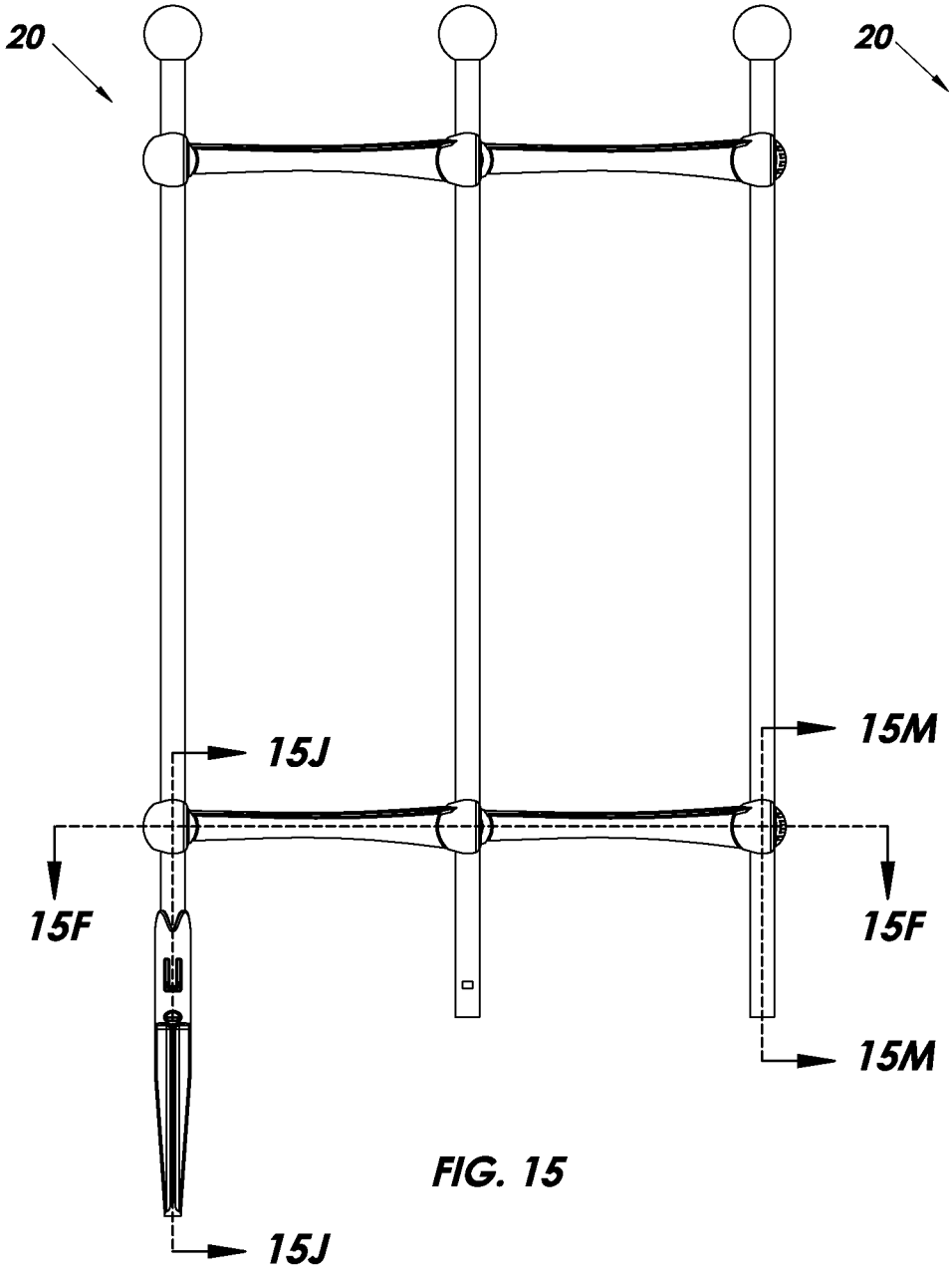
FIGS. 15 and 15A are front and side elevation views, respectively, of the representative portion of the fence system.
Figure 15A:
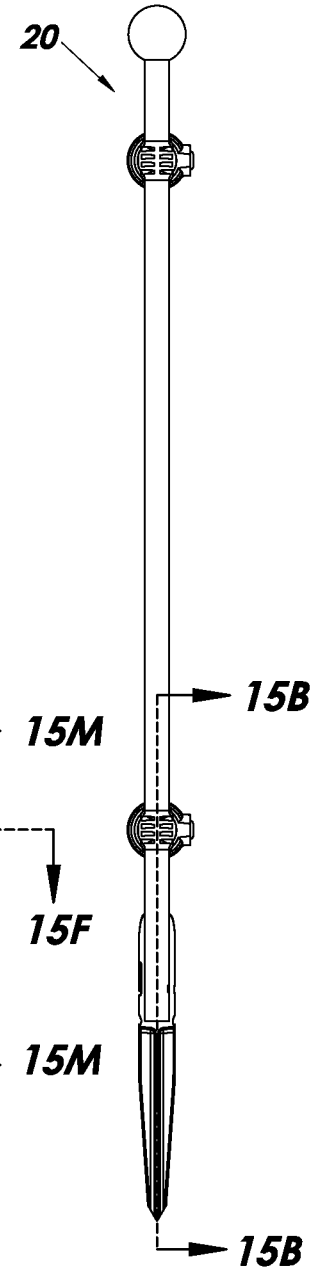
Figure 15B:
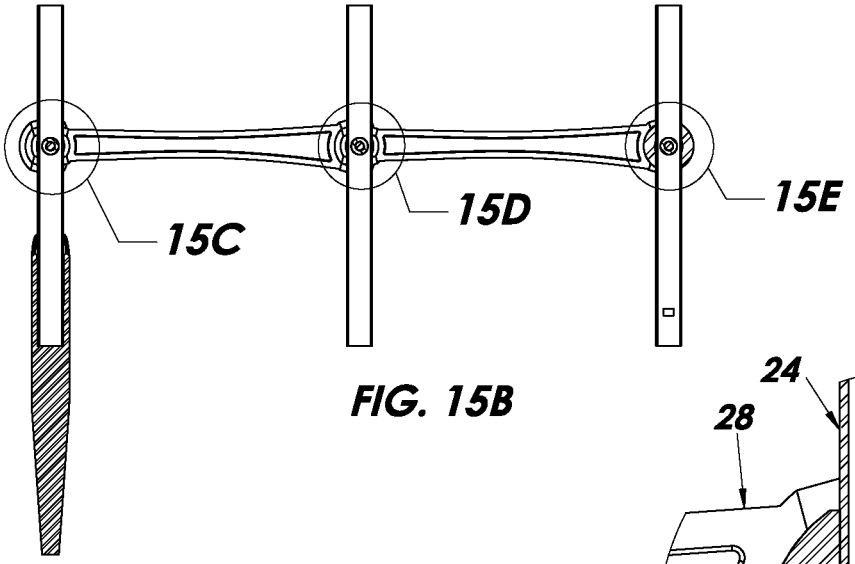
FIG. 15B is a cross-sectional view taken from FIG. 15A.
Figure 15E:
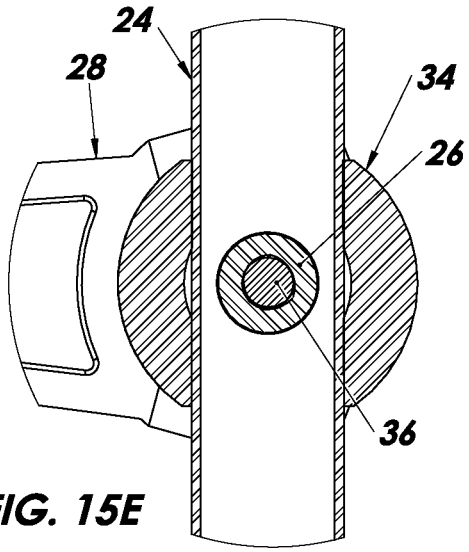
FIGS. 15C, 15D and 15E are detail views of FIG. 15B.
Figure 15C:
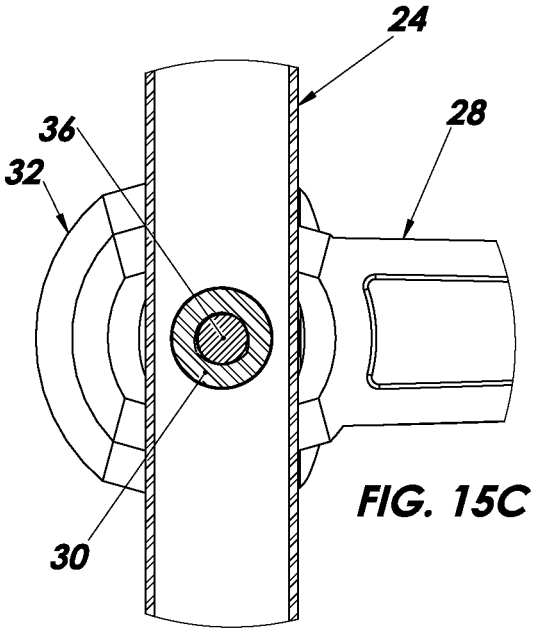
Figure 15D:
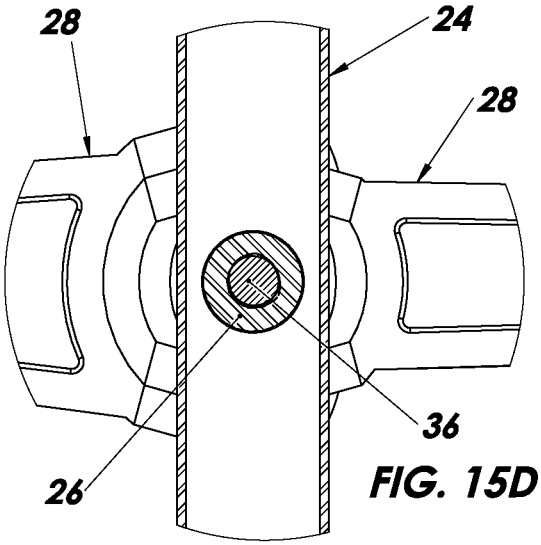
Figure 15F:
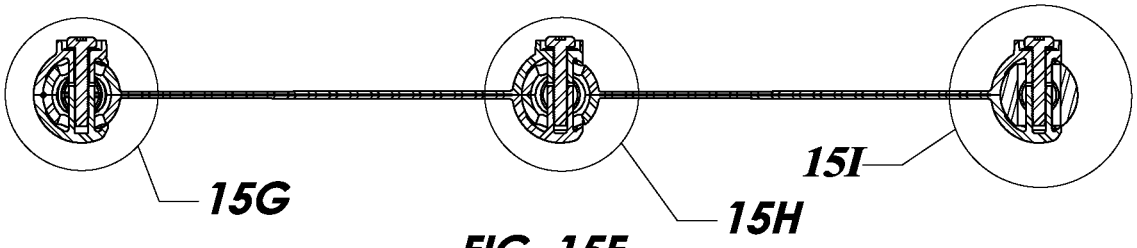
FIG. 15F is a cross-sectional view taken from FIG. 15.
Figure 15G:
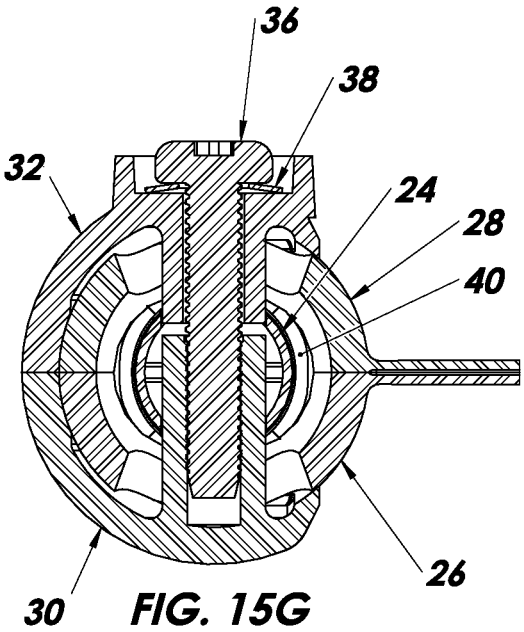
FIGS. 15G, 15H and 15I are detail views of FIG. 15F.
Figure 15I:
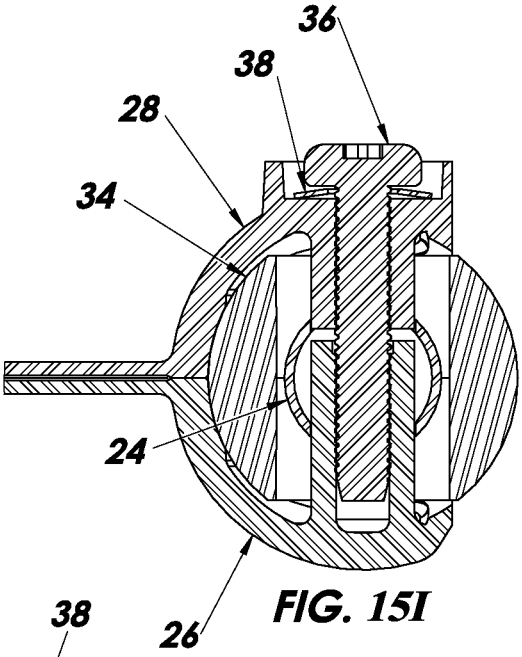
Figure 15H:
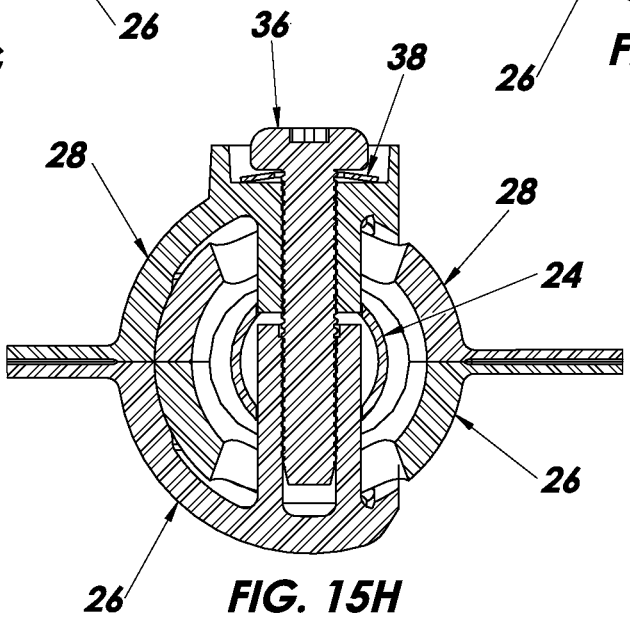
Figure 15J:
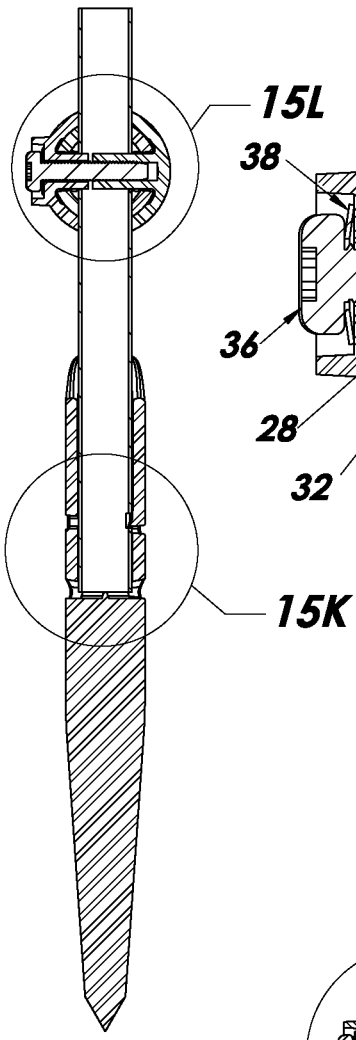
FIG. 15J is a cross-sectional view taken from FIG. 15.
Figure 15L:
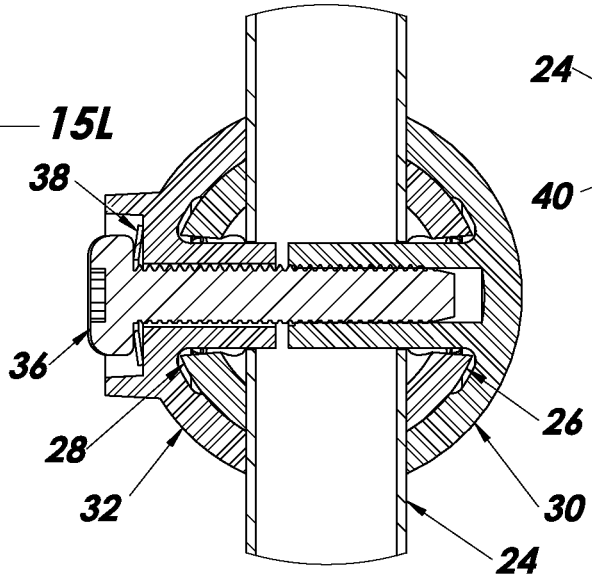
FIGS. 15K and 15L are detail views of FIG. 15J.
Figure 15K:
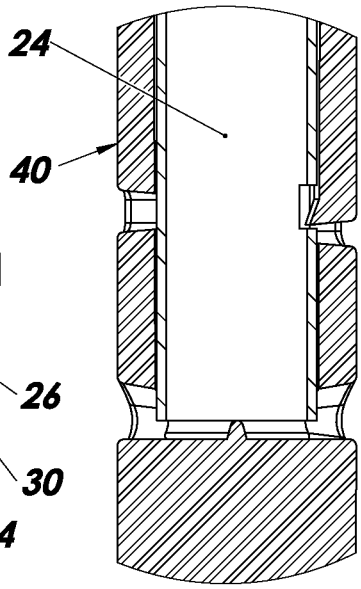
Figure 15M:
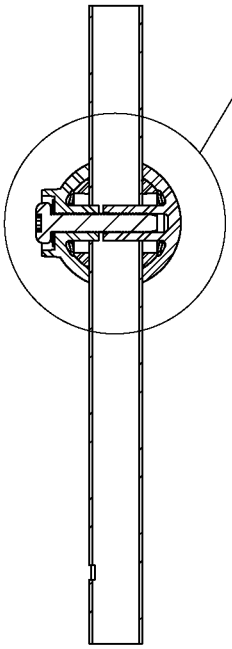
FIG. 15M is a cross-sectional view taken from FIG. 15.
Figure 15N:
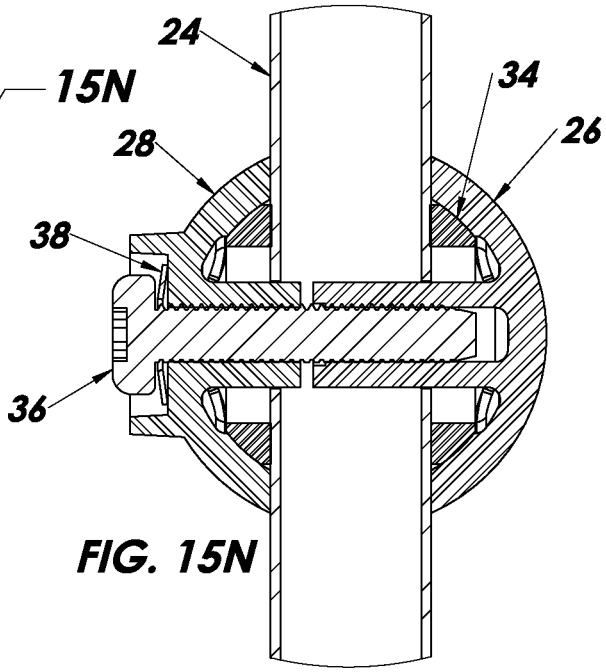
FIG. 15N is a detail view of FIG. 15M.

Also, once assembled, an inner end of the pin boss 90 can be spaced apart from an inner end of the pin boss 64 to define a gap therebetween (see FIGS. 15G, 15H and 15I). The gap can ensure that the clamping force is transmitted through the clamping surfaces and not the pin bosses 64, 90.

A web 98 joins the ends 84, 86, and can be of any suitable shape. Where the web 98 interfaces with the ends 84, 86, it can be sized to allow maximum travel of the rear links 28 without interference, and while maintaining adequate strength characteristics. In the example illustrated, the web 98 includes an inner mating surface 104, which extends substantially between the ends 84, 86.

In the example illustrated, the webs 70, 98 are of similar size and shape, and the mating surfaces 76, 104 can engage one another between the first and second ends. In some examples, the front and rear links 26, 28 can be made to be very different in size, shape and/or appearance. In other examples, portions of the links can be combined into a single part. In other examples, portions of the links can be separate components but made integral during assembly, using, for example, snap-fit design or other joining technique.

In the example illustrated, the ends 84, 86 can include respective inner surfaces 100, 102. The inner surfaces 100, 102 can generally abut the posts 24 and can be sized and shaped so that the ends 84, 86 are coupled with the posts 24 in a locational clearance fit. In some examples, the inner surfaces 100, 102 can be sized and shaped to provide nominal clearance to the posts 24 to account for tolerances, and/or to ensure proper mating of surfaces 76, 104 and/or surfaces 106, 108 (described below). In some examples, the inner surfaces 100, 102 can provide clearance so that the rear link 28 can be positioned with the second link axis 88 at an angle offset of 90 degrees relative to the post axis 44.

In the example illustrated, an outer side of the first end 84 includes a convex clamping surface 106, and an inner side of the second end 86 includes a concave clamping surface 108 for complementary engagement with the convex clamping surface 106. The surfaces 106, 108 are contact surfaces that can provide for friction when a clamping force is applied. Increasing surface roughness of the surfaces 106, 108 can increase holding power. Surface roughness can be incorporated by texturing the appropriate surfaces in the injection mold for this part.

In the example illustrated, the inner side of the female end 86 includes a contact relief area 110 arranged between the pin boss 90 and the concave clamping surface 108. The contact relief area 110 can provide for the parts to contact each other spaced apart from the spherical center. This can provide for a larger mechanical advantage, such that the friction between the surfaces 106, 108 is maximized and hence the joint can carry more load.

Referring to FIGS. 11, 11A, 11B, 11C, 11D, 11E, 11F, 11G and 11H, the front end cap 30 can be used at one extreme end of the fence system 20, and specifically the end having the male ends 58, 84 of the links 26, 28. In the example illustrated, the front end cap 30 is hemispherical and complementary in shape and size to the male end 58, so that, when assembled, the front end cap 30 can generally envelop the male end 58 of the last front link 26 in the repeating chain.

In the example illustrated, the front end cap 30 includes a pin boss 112. The pin boss 112 can include a bore 114 that is sized appropriately for proper engagement of a thread forming or thread cutting screw, which can eliminate the need to mold or machine threads into the bore 114.

In the example illustrated, the front end cap 30 includes an inner surface 116. The inner surface 116 can generally abut the posts 24 and can be sized and shaped so that the front end cap 30 is coupled with the posts 24 in a locational clearance fit.

In the example illustrated, an inner side of the front end cap 30 includes a concave clamping surface 118 for complementary engagement with the convex clamping surface 78. The inner side of the front end cap 30 can also include a contact relief area 120 arranged between the pin boss 112 and the concave clamping surface 118.

Referring to FIGS. 12, 12A, 12B, 12C, 12D, 12E, 12F, 12G and 12H, the rear end cap 32 can also be used at one extreme end of the fence system 20, and specifically the end having the male ends 58, 84 of the links 26, 28. In the example illustrated, the rear end cap 32 is hemispherical and complementary in shape and size to the male end 84, so that, when assembled, the rear end cap 32 can generally envelop the male end 84 of the last rear link 28 in the repeating chain.

In the example illustrated, the rear end cap 32 includes a pin boss 122. The pin boss 122 can include a through bore 124 that is sized appropriately for proper clearance of the screws 36. The rear end cap 32 is also shown to include a recess 126 for seating the disc springs 38, which can be concentric with the through bore 124.

In the example illustrated, the rear end cap 32 includes an inner surface 128. The inner surface 128 can generally abut the posts 24 and can be sized and shaped so that the rear end cap 32 is coupled with the posts 24 in a locational clearance fit.

In the example illustrated, an inner side of the rear end cap 32 includes a concave clamping surface 130 for complementary engagement with the convex clamping surface 106. The inner side of the rear end cap 32 can also include a contact relief area 132 arranged between the pin boss 122 and the concave clamping surface 130.

In some examples, the end caps and/or portions of the end caps can be combined into a single part. In other examples, portions of the end caps can be separate components but made integral during assembly, using, for example, snap-fit design or other joining technique.

Referring to FIGS. 13, 13A, 13B, 13C, 13D, 13E, 13F, 13G and 13H, the pivot ball 34 can also be used at one extreme end of the fence system 20, and specifically the end having the female ends 60, 86 of the links 26, 28. The pivot ball 34 can be spherical in shape. The pivot ball 34 can be assembled by sliding a central bore 134 over one of the ends 46, 48 of the post 24. The perpendicular or lateral bore 136 can be aligned in registration with the holes 50 (or the holes 52) in the post 24. The pivot ball 34 can be held in position by the pin boss 64 of the front link 26 and the pin boss 90 of the rear link 28, which can engage the holes 50 (or the holes 52) in the post 24. When assembled, the female ends 60, 86 can generally envelop and clamp onto the pivot ball 34.

In the example illustrated, the pivot ball 34 includes a convex clamping surface 138 for complementary engagement with the concave clamping surfaces 80, 108.

In some examples, the pivot ball can be constructed of two or more separate pieces. This can be required in cases where the posts are of a size or shape that does not allow the installation of a single piece pivot ball, including, for example, in cases where the post is molded and contains features such as bosses or a finial that are larger in size than the central bore 134.

Referring to FIGS. 14, 14A, 14B, 14C, 14D, 14E and 14F, the stakes 40 can be used to secure the fence system 20 to the ground. In some examples, the stakes 40 can be used on every post, or as required or desired. In other examples, the stakes 40 can be replaced with a similar part that can, for example, have a flange to secure the fence system 20 to a flat surface, such as a concrete pad. In other examples, the stakes 40 can be omitted and the posts 24 can be secured directly into the ground surface.

In the example illustrated, the stake 40 includes a blade 140 that can penetrate the ground on its bottom end, and a receptacle 142 for securing the bottom end 46 of the post 24. The receptacle 142 can include a bore 144 that is sized and shaped to tightly contain the post 24. A bottom end of the bore 144 can include holes 146 that can allow for water drainage, and a rib 148 that can prevent the bottom end 46 of the post 24 from contacting a bottom floor of the bore 144, this can reduce the potential for corrosion of the post 24.

Figure 7A:
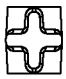
FIGS. 7, 7A and 7C are orthogonal, projected and perspective views, respectively, of another example of a post of the fence system.
Figure 7C:
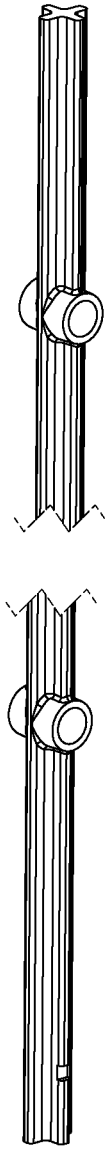
Figure 7:
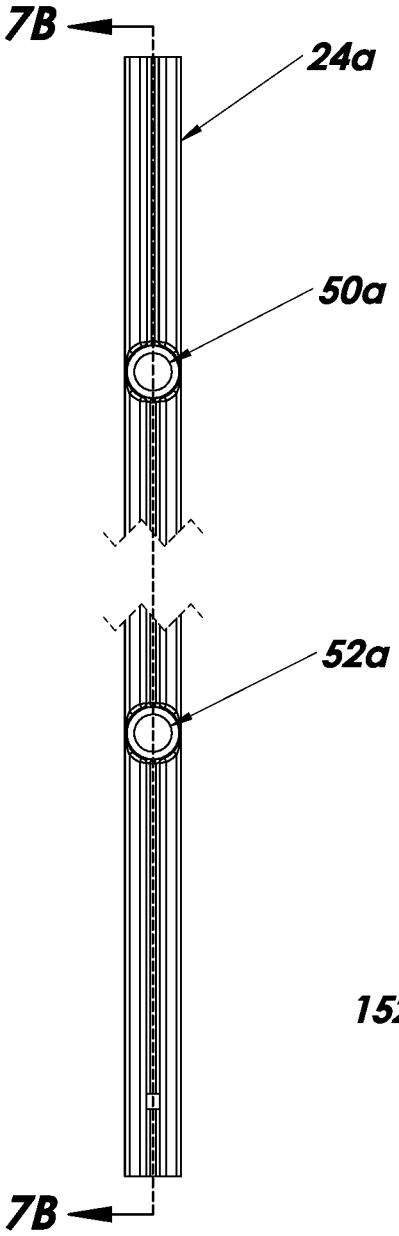
Figure 7B:
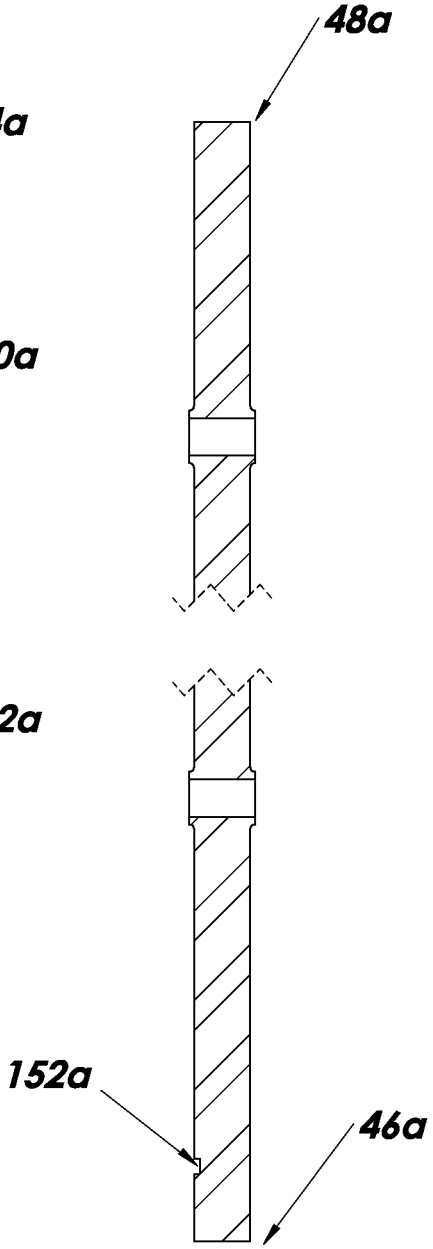
FIG. 7B is a cross-sectional view taken from FIG. 7.
Figure 8A:
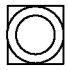
FIGS. 8, 8A and 8C are orthogonal, projected and perspective views, respectively, of another example of a post of the fence system.
Figure 8C:
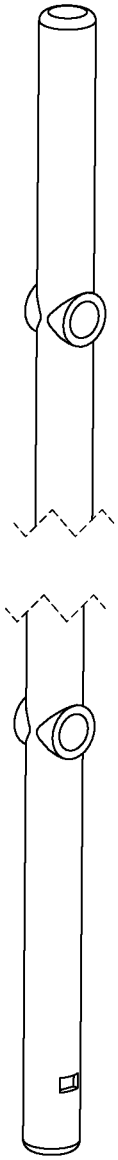
Figure 8:
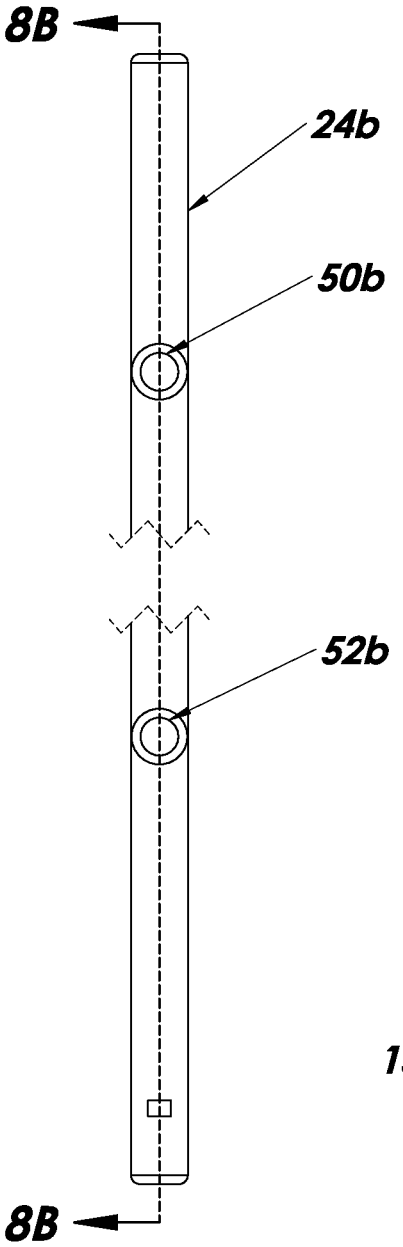
Figure 8B:
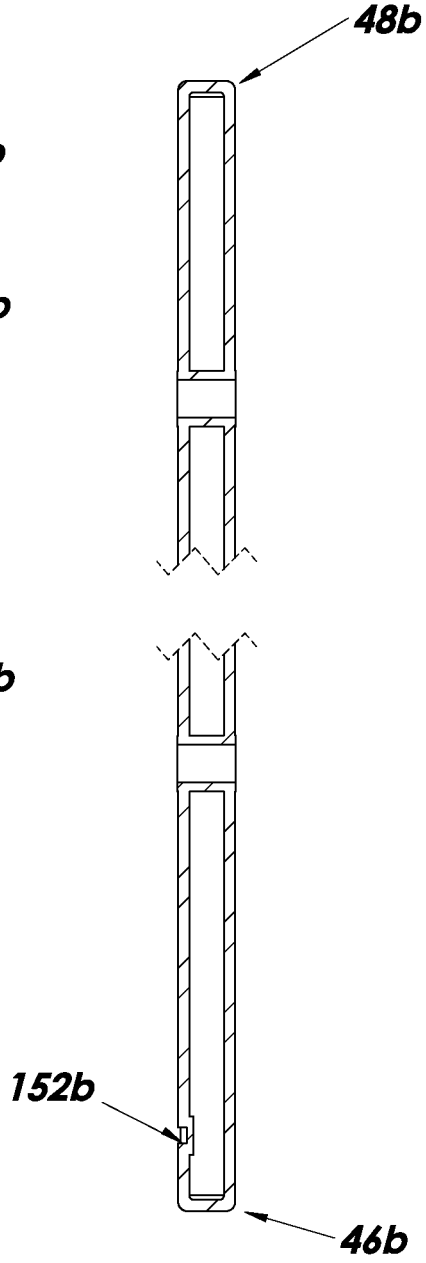
FIG. 8B is a cross-sectional view of FIG. 8.
Figure 9I:
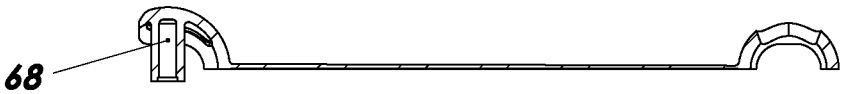
FIGS. 9I and 9J are cross-sectional views taken from FIG. 9B.
Figure 9B:
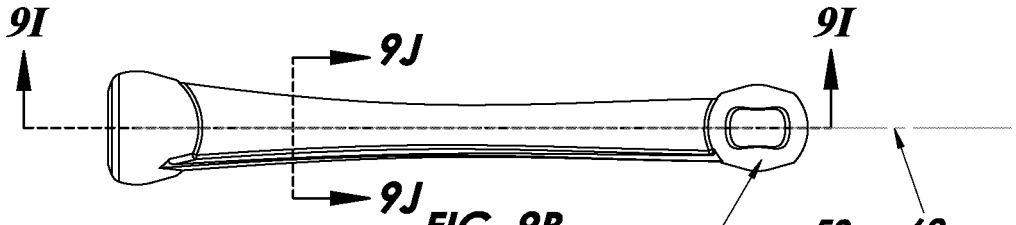
FIGS. 9A, 9B, 9C and 9D are projected views of the front link.
Figure 9A:
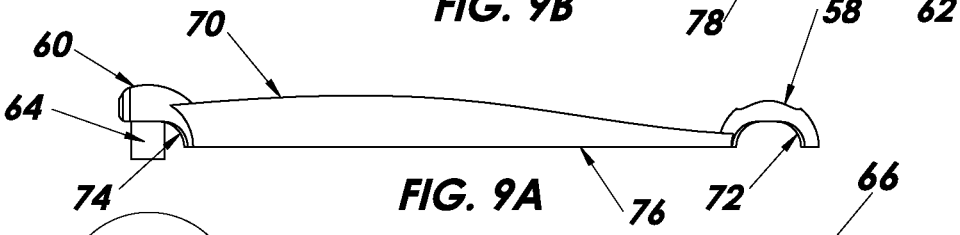
Figures 9, 9C, 9D:
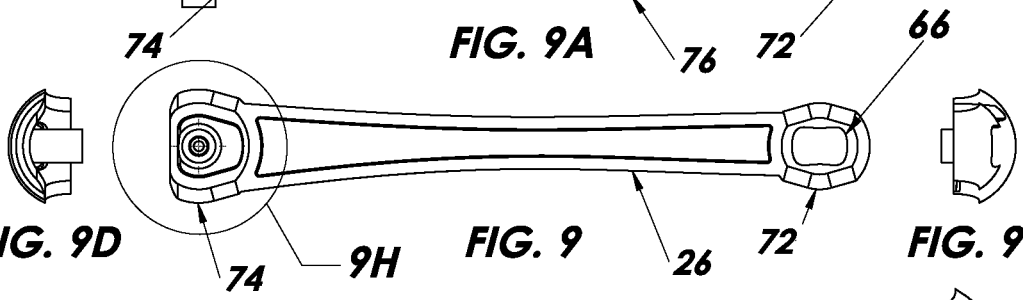
FIG. 9 is an orthogonal view of an example of a front link of the fence system.
Figure 9H:
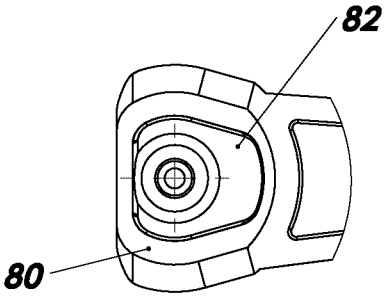
FIG. 9H is a detail view of FIG. 9.
Figure 9J:
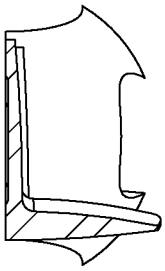
Figure 9E:
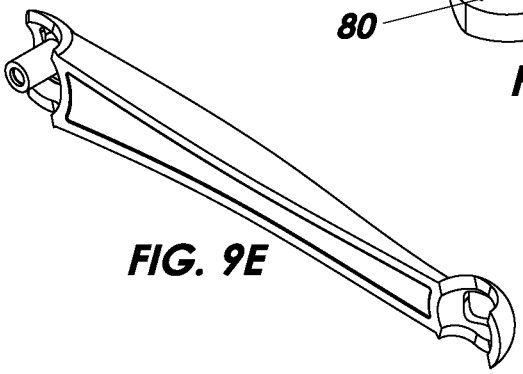
FIGS. 9E, 9F and 9G are perspective views of the front link.
Figure 9G:
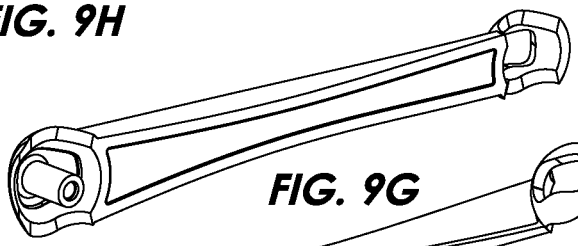
Figure 9F:
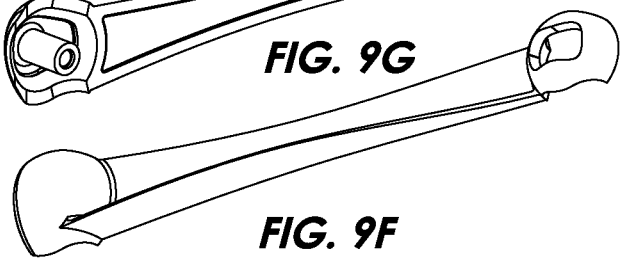
Figures 10, 10A, 10B, 10C, 10D, 10E, 10F, 10G, 10H, 10I, 10J:
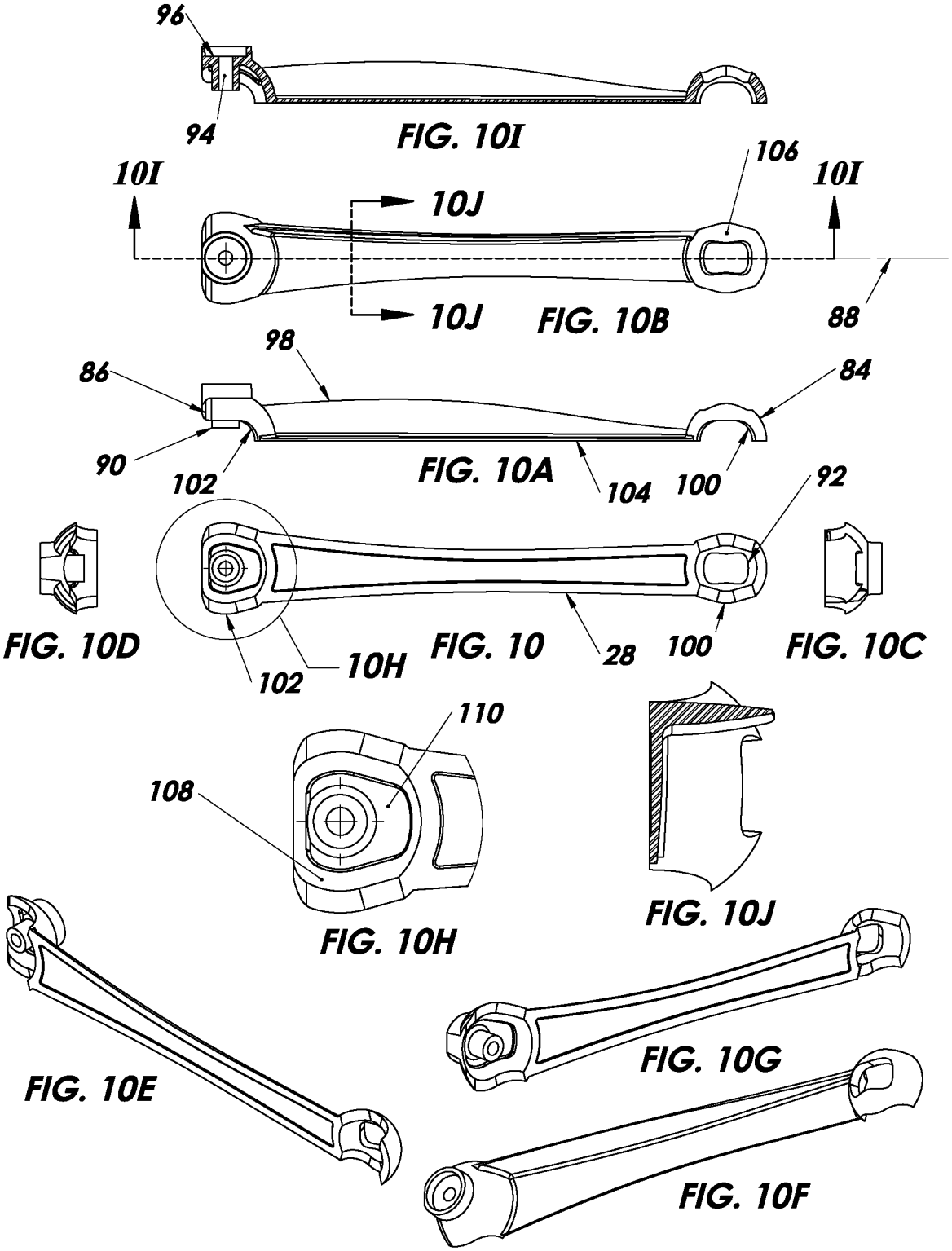
Figure 11G:
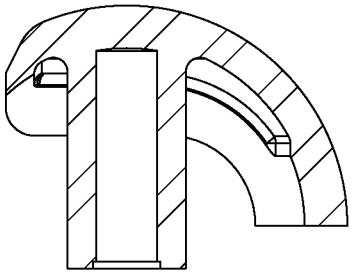
FIGS. 11G and 11H are cross-sectional views taken from FIG. 11.
Figure 11A:
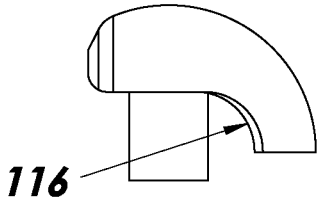
FIGS. 11A, 11B, 11C and 11D are projected views of the front end cap.
Figure 11H:
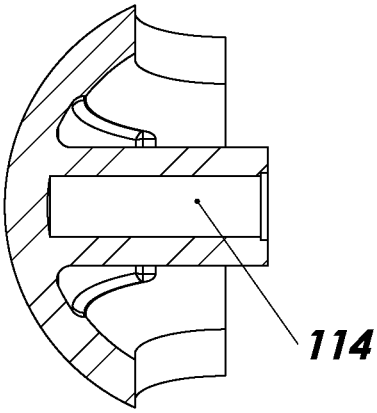
Figure 11C:
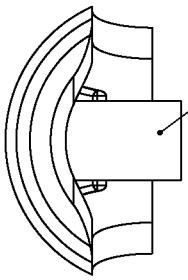
Figure 11:
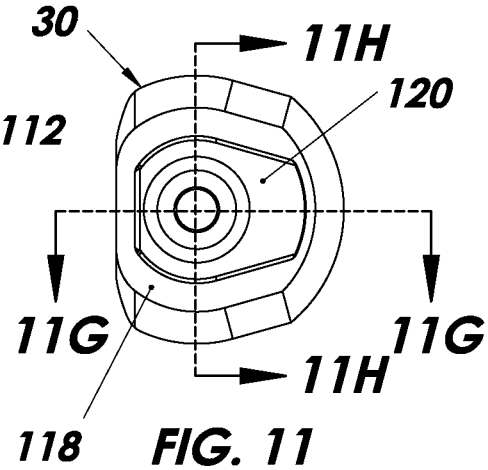
FIG. 11 is an orthogonal view of an example of a front end cap of the fence system.
Figure 11D:
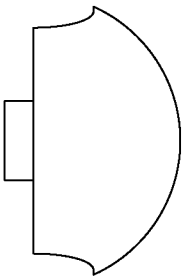
Figure 11E:
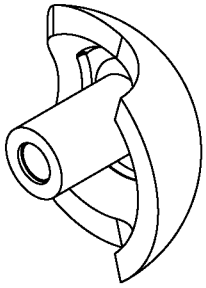
FIGS. 11E and 11F are perspective views of the front end cap.
Figure 11B:
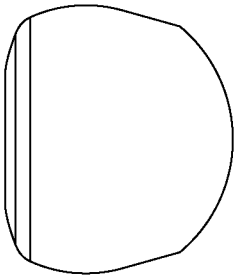
Figure 11F:
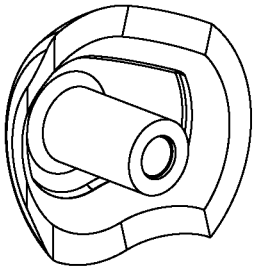
Figure 12G:
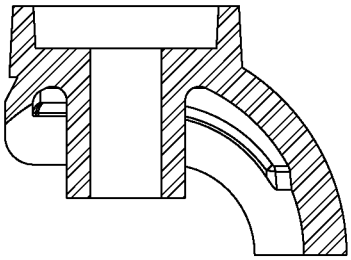
FIGS. 12G and 12H are cross-sectional views taken from FIG. 12.
Figure 12H:
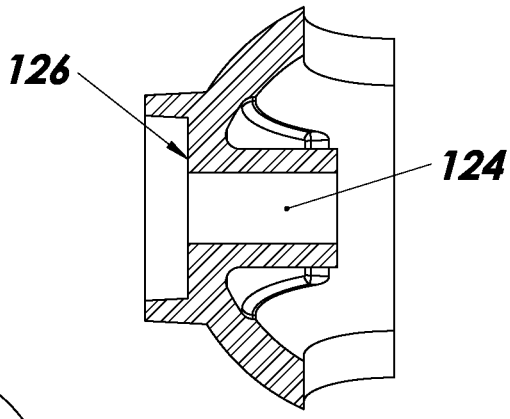
Figure 12A:
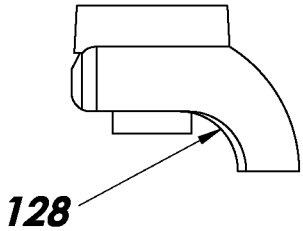
FIGS. 12A, 12B, 12C and 12D are projected views of the rear end cap.
Figure 12D:
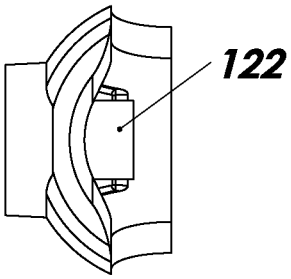
Figure 12:
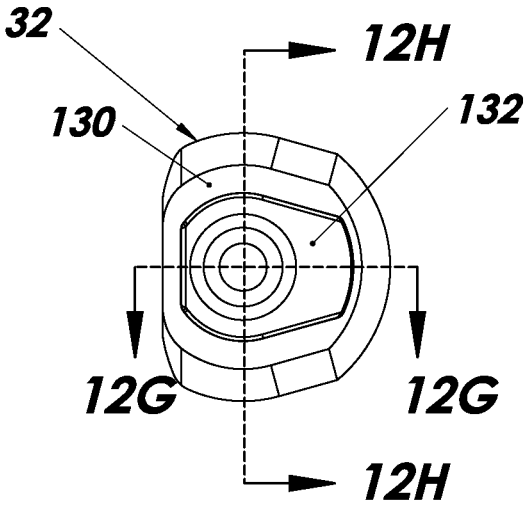
FIG. 12 is an orthogonal view of an example of a rear end cap of the fence system.
Figure 12C:
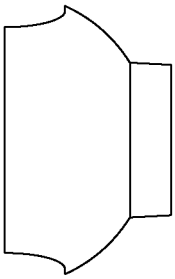
Figure 12E:
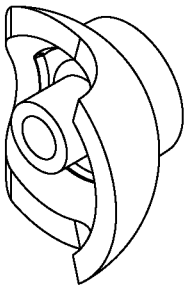
FIGS. 12E and 12F are perspective views of the rear end cap.
Figure 12B:
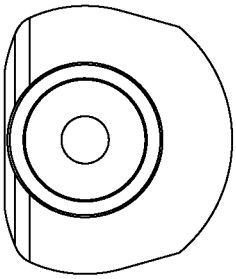
Figure 12F:
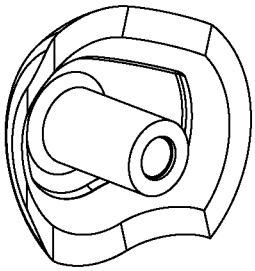
Figure 13G:
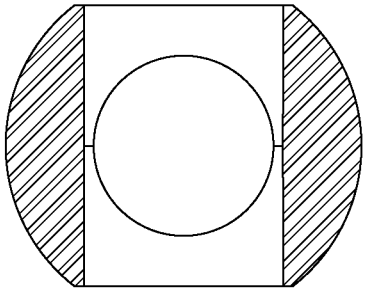
FIGS. 13G and 13H are cross-sectional views taken from FIG. 13.
Figure 13A:
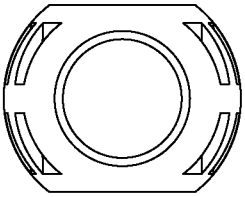
FIGS. 13A, 13B, 13C and 13D are projected views of the pivot ball.
Figure 13H:
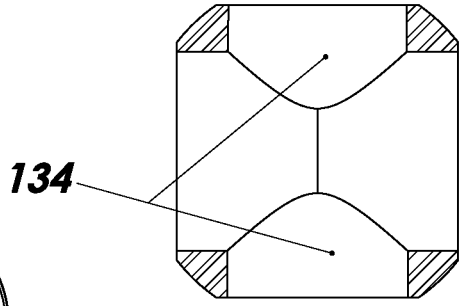
Figure 13D:
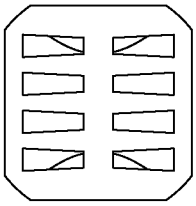
Figure 13:
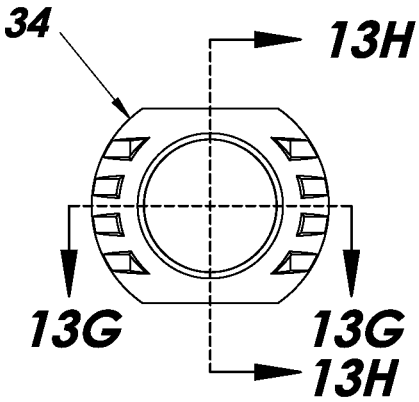
FIG. 13 is an orthogonal view of an example of a pivot ball of the fence system.
Figure 13C:
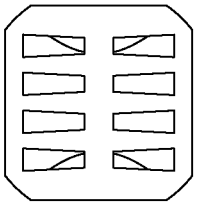
Figure 13E:
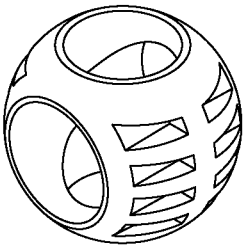
FIGS. 13E and 13F are perspective views of the pivot ball.
Figure 13B:
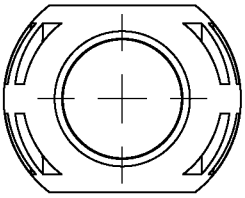
Figure 13F:
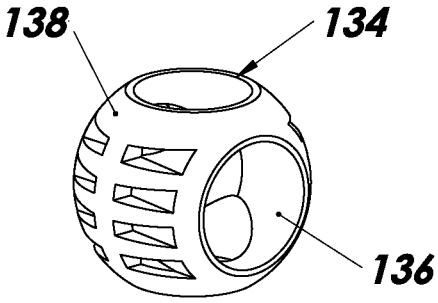
Figure 14A:
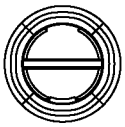
FIGS. 14A, 14B and 14C are projected views of the stake.
Figure 14C:
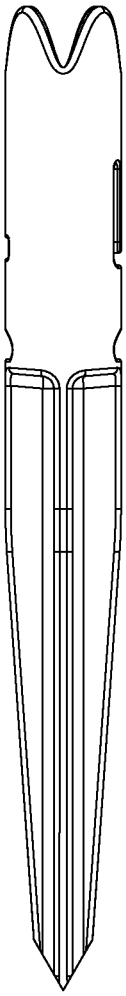
Figure 14:
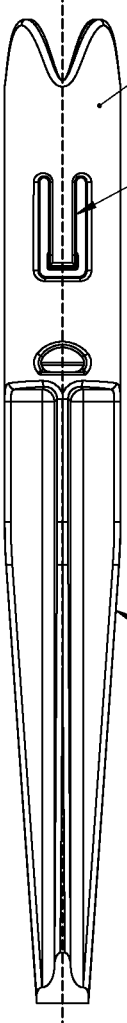
FIG. 14 is an orthogonal view of an example of a stake of the fence system.
Figure 14D:
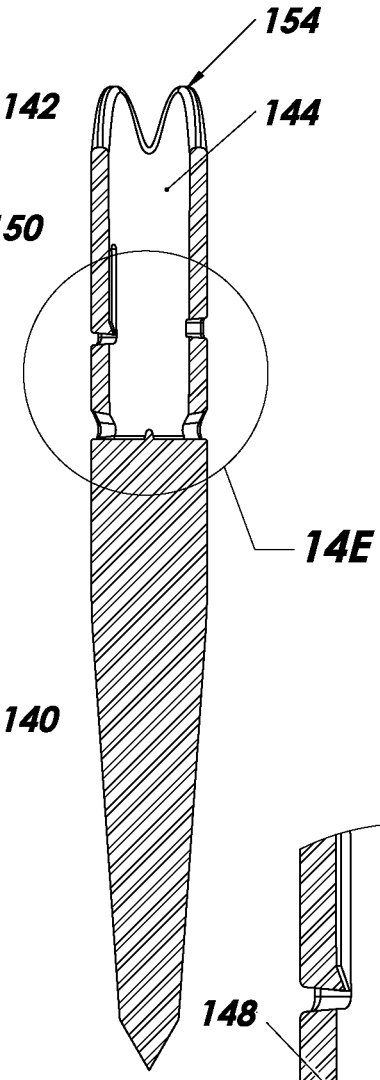
FIG. 14D is a cross-sectional view taken from FIG. 14.
Figure 14F:
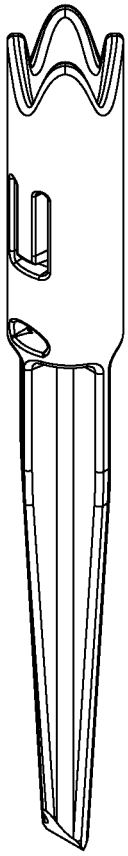
FIG. 14F is a perspective view of the stake.
Figure 14B:
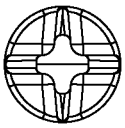
Figure 14E:
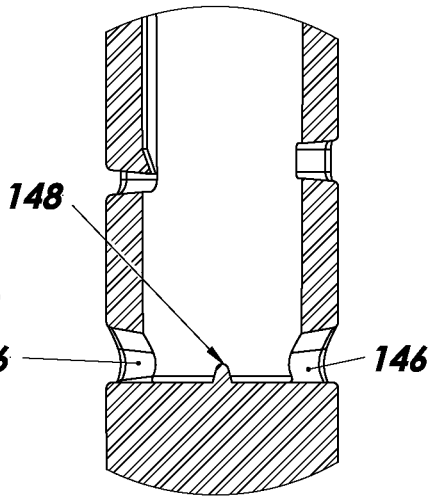
FIG. 14E is a detail view of FIG. 14D.

In the example illustrated, the receptacle 142 includes a snap feature 150 that can allow the post 24 to be inserted but prevent it from being pulled out. The snap feature 150 can engage a retaining feature 152 in the wall of post 24 (see FIG. 6). Corresponding retaining features 152*a*, 152*b* are also shown in FIGS. 7B and 8B, respectively. A top rim 154 of the receptacle 142 can be undulating in shape, which can more effectively distribute loads on the post 24 and can help to prevent the post 24 from buckling if impacted.

An outside corner 156 and an inside corner 158 can be utilized when there is a need for the fence system 20 to make a relatively sharp turn, for example, a ninety degree turn, on the horizontal plane, and which is outside the range of motion available with the links 26, 28. Usage of the corners 156, 158 in a corner assembly is illustrated in FIGS. 17, 17A, 17B, 17C and 17D. The outside corner 156 is further illustrated in FIGS. 18, 18A, 18B, 18C, 18D, 18E and 18F. The inside corner 158 is further illustrated in FIGS. 19, 19A, 19B, 19C, 19D, 19E and 19F. The functions and general features of the corners 156, 158 can be similar to that of the links 26, 28. The corners 156, 158 can preserve the full range of motion of the attached horizontal links.

Further details regarding the fence system 20 are illustrated in FIGS. 15, 15A, 15B, 15C, 15D, 15E, 15F, 15G, 15H, 15I, 15J, 15K, 15L, 15M and 15N.

Figure 16A:
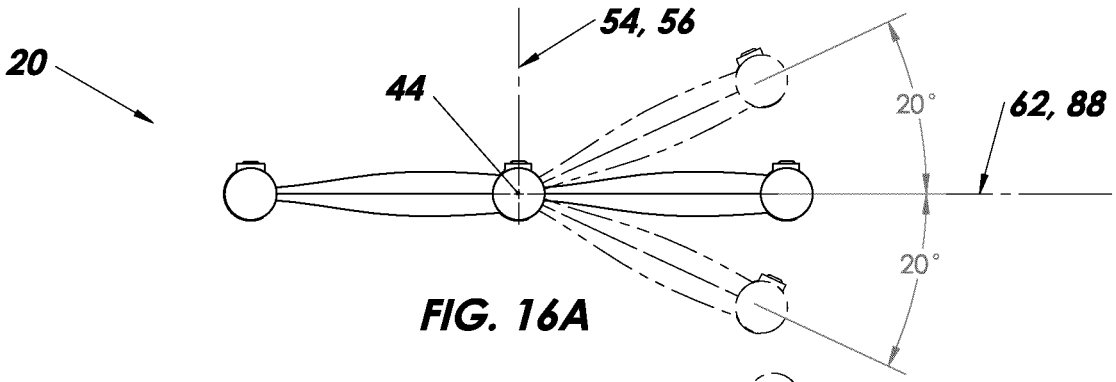
FIGS. 16 and 16A are front elevation and plan views, respectively, of the representative portion of the fence system.
Figure 16:
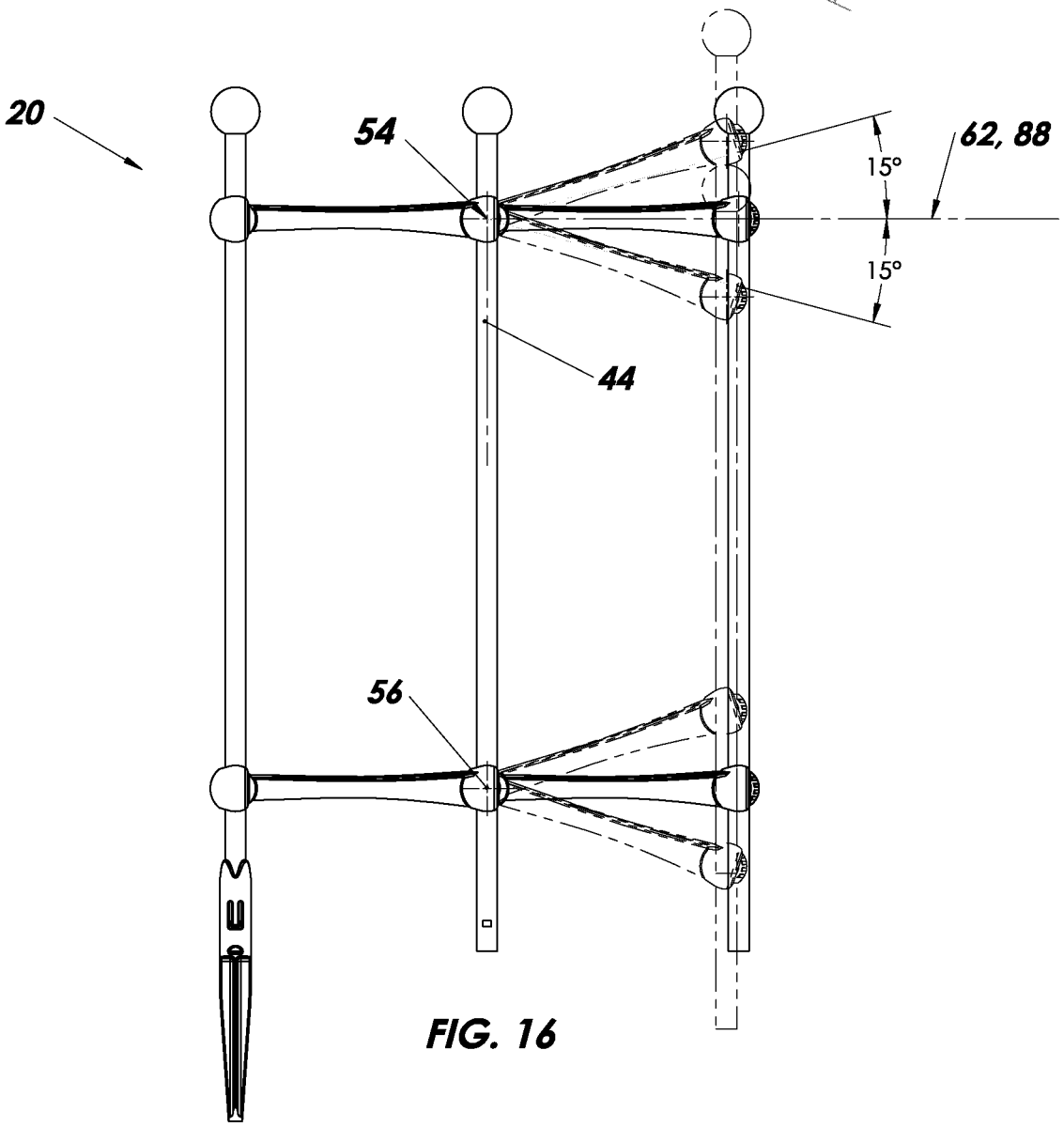
Figure 17A:
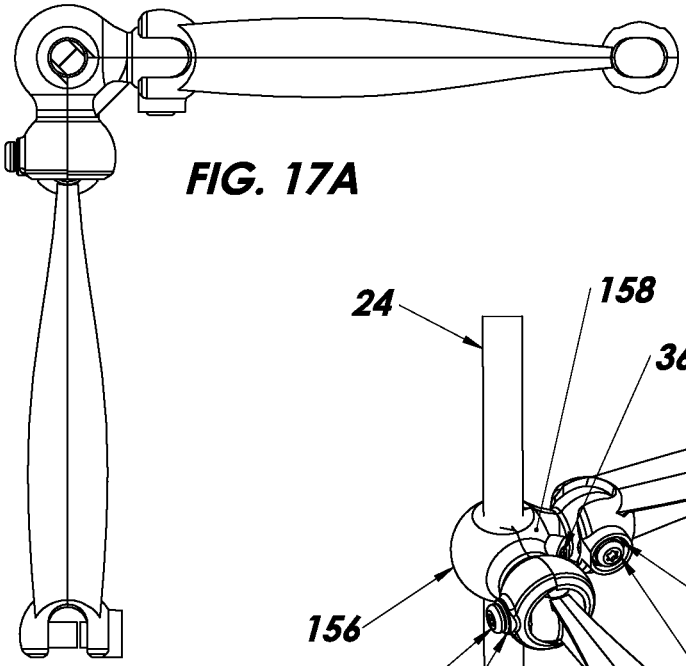
FIGS. 17, 17A and 17B are orthogonal, projected and perspective views, respectively of an example of a corner assembly of the fence system.
Figure 17B:
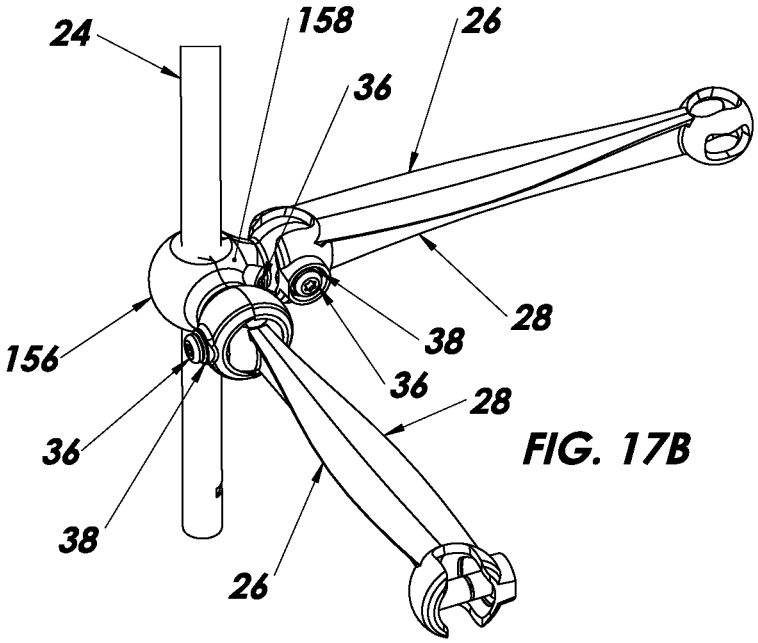
Figure 17:
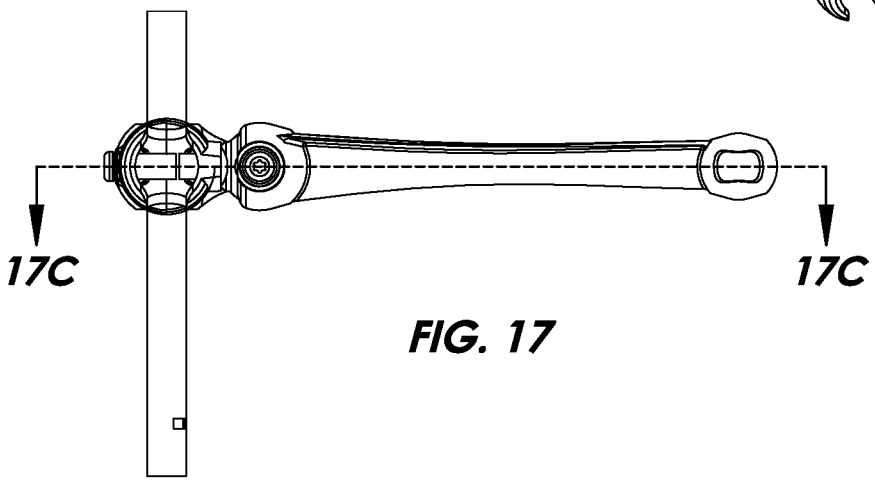
Figure 17C:
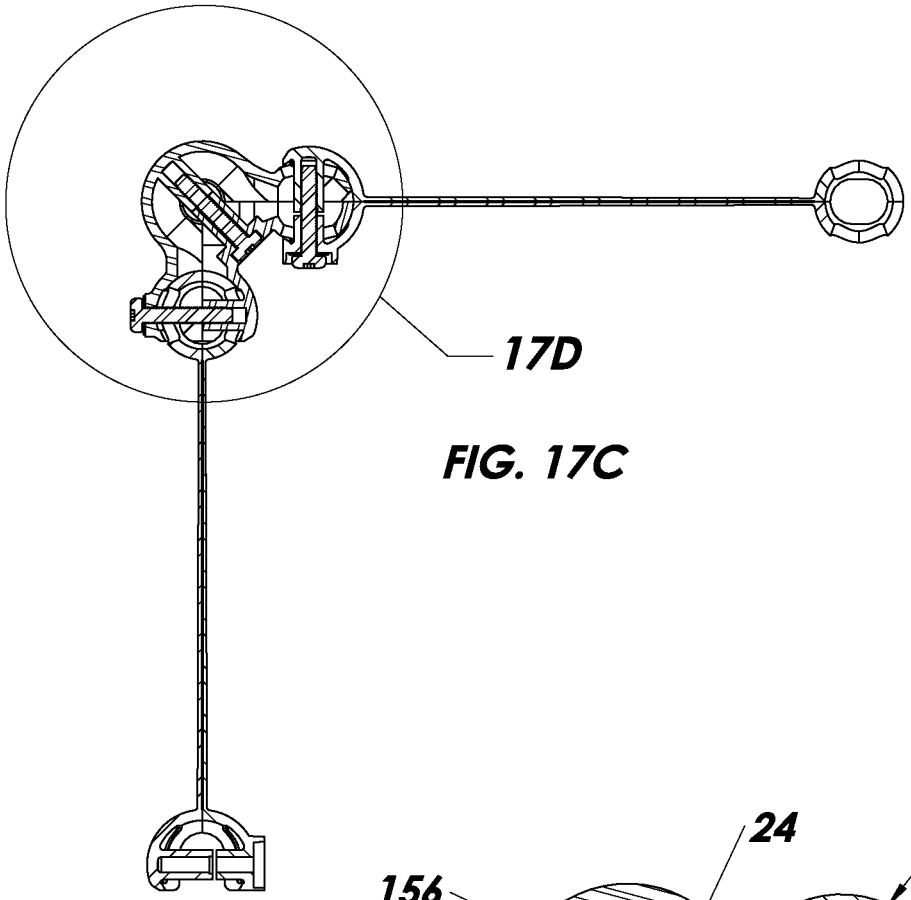
FIG. 17C is a cross-sectional view taken from FIG. 17.
Figure 17D:
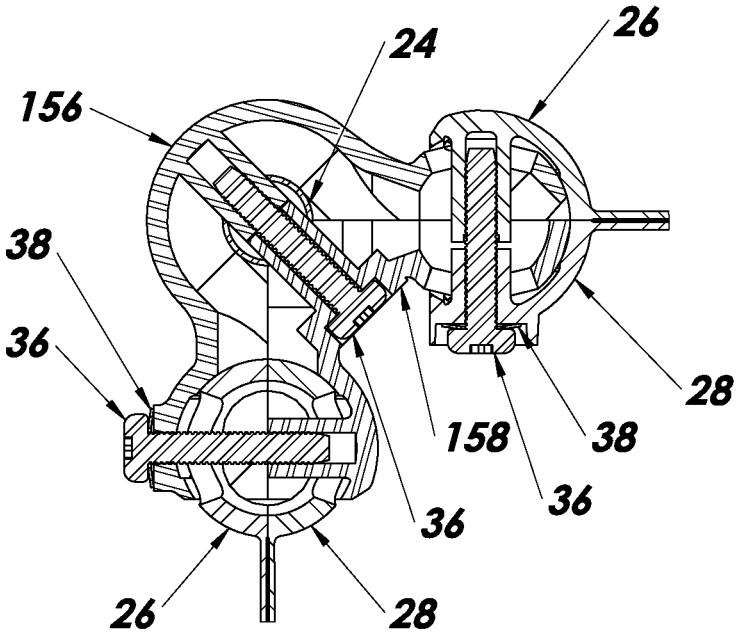
FIG. 17D is a detail view of FIG. 17C.
Figure 18E:
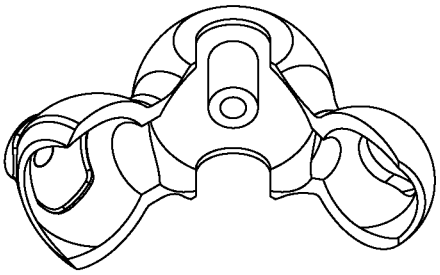
FIGS. 18E and 18F are perspective views showing the outside corner.
Figure 18F:
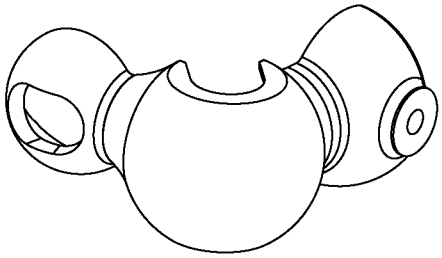
Figure 18D:
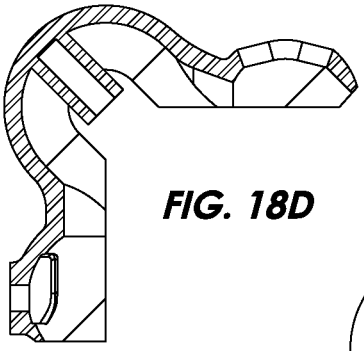
FIG. 18D is a cross-sectional view taken from FIG. 18.
Figure 18A:
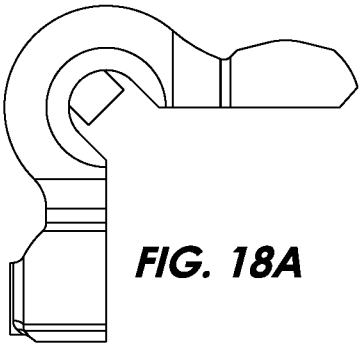
FIGS. 18A, 18B and 18C are projected views of the outside corner.
Figure 18B:
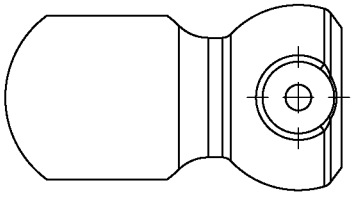
Figure 18:
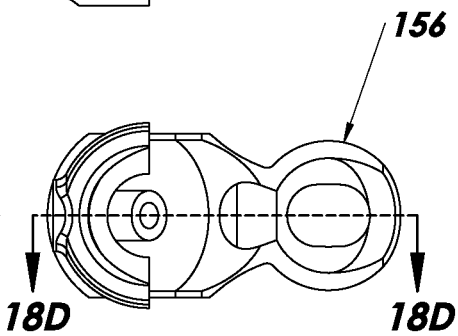
FIG. 18 is an orthogonal view of an example of an outside corner of the fence system.
Figure 18C:
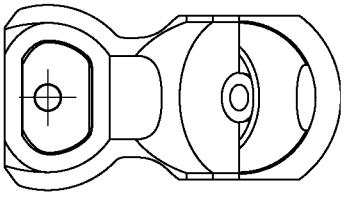
Figure 19E:
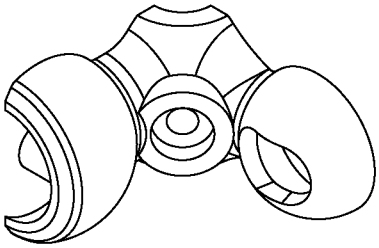
FIGS. 19E and 19F are perspective views showing the outside corner.
Figure 19F:
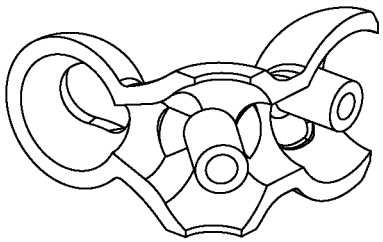
Figure 19D:
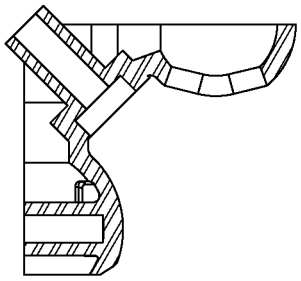
FIG. 19D is a cross-sectional view taken from FIG. 19.
Figure 19A:
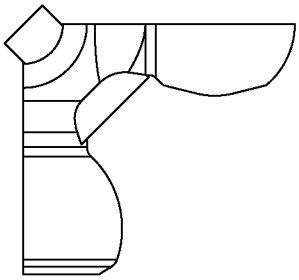
FIGS. 19A, 19B and 19C are projected views of the inside corner.
Figure 19B:
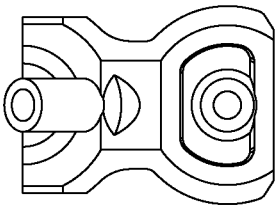
Figure 19:
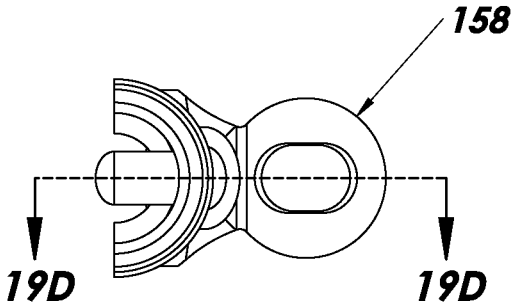
FIG. 19 is an orthogonal view of an example of an inside corner of the fence system.
Figure 19C:
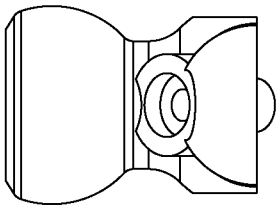

As mentioned above, the pin bosses can be free to rotate within the holes 50, 52 to provide a range of motion for assembly of the links 26, 28 to the posts 24. To illustrate this, reference is made to FIGS. 16 and 16A. In the example illustrated, the fence system 20 has freedom of movement in the vertical plane (FIG. 16) and the horizontal plane (FIG. 16A). In particular, as shown in FIG. 16, in a plane parallel to the post axis 44, the link axes 62, 88 can intersect the hole axis 54 (or hole axis 56) and the position can be varied about the hole axis 54 by approximately ±15 degrees. Furthermore, as shown in FIG. 16A, in a plane parallel to the hole axis 54 (or hole axis 56), the link axes 62, 88 can intersect the post axis 44 and the position can be varied about the post axis 44 by approximately ±20 degrees.

The links 26, 28, the end caps 30, 32, the pivot balls 34, the stakes 40, the finials 42, and/or the corners 156, 158 can each be manufactured using plastic or metal injection molding. Other process can be utilized, including, but not limited to, forging and compression molding. Suitable materials for these components can include, but are not limited to, many plastic resins such as polycarbonate, and metals such as zinc or aluminum alloys. In the case of plastic resins, reinforcing fillers such as glass or carbon fibers can be used to enhance desired physical properties, including strength and dimensional stability. Other additives can be utilized, including, but not limited to, UV stabilizers.

It will be appreciated that terms used herein to convey geometrical or mathematical relationships need not be construed with absolute precision. For example, the terms 'convex' and/or 'concave' as used herein need not be interpreted to mean structures having a curved surface that is exactly spherical. Furthermore, the terms 'parallel', 'perpendicular' and/or 'orthogonal' can be interpreted with some flexibility, without strict adherence to the mathematical definitions, as will be appreciated by persons skilled in the art.

While the above description provides examples of one or more apparatuses or methods, it will be appreciated that other apparatuses or methods may be within the scope of the accompanying claims.

The invention claimed is:

1. A kit of parts for assembling a fence, comprising:

a plurality of posts, each of the posts extending lengthwise between a first end and a second end, each of the posts comprising at least one hole that extends through the post generally intermediate the first and second ends;

a plurality of front links, each of the front links comprising a first end, a second end spaced apart from the first end, and a first link web joining the first and second ends, the first end comprising an inner surface for abutting the post and an outer clamping surface, and the second end comprising an inner clamping surface for complementary engagement with the outer clamping surface of the first end of an adjacent front link;

a plurality of rear links, each of the rear links comprising a first end, a second end spaced apart from the first end, and a second link web joining the first and second ends, the first end comprising an inner surface for abutting the post and an outer clamping surface, and the second end comprising an inner clamping surface for complementary engagement with the outer clamping surface of the first end of an adjacent rear link; and a plurality of fasteners, and once assembled, each of the fasteners extends through the hole of a respective one of the posts and applies a clamping force that urges the second ends of a pair of the front and rear links towards the respective one of the posts to opposingly bear against the first ends of an adjacent pair of the front and rear links.

2. A system, comprising:

a plurality of posts, each of the posts extending lengthwise along a post axis between a first end and a second end, each of the posts comprising at least one hole that extends through the post generally intermediate the first and second ends, the hole defining a hole axis that is generally coplanar with and generally orthogonal to the post axis;

a plurality of first links, each of the first links comprising a first end, a second end spaced apart from the first end along a first link axis, and a first link web joining the first and second ends;

a plurality of second links, each of the second links comprising a first end, a second end spaced apart from the first end along a second link axis, and a second link web joining the first and second ends; and a plurality of fasteners, and once assembled, each of the fasteners extends through the hole of a respective one of the posts and couples the first ends of first ones of the first and second links to the second ends of second ones of the first and second links thereby securing the links to the post, wherein each of the fasteners applies a clamping force that urges the second ends of the second ones of the first and second links towards the respective post to opposingly bear against the first ends of the first ones of the first and second links, wherein an outer side of the first end of the first one of the first links comprises a first clamping surface, and an inner side of the second end of the second one of the first links comprises a complementary second clamping surface for engagement with the first clamping surface of the first one of the first links, and wherein an outer side of the first end of the first one of the second links comprises a first clamping surface, and an inner side of the second end of the second one of the second links comprises a complementary second clamping surface for engagement with the first clamping surface of the first one of the second links.

3. A fence system, comprising:

a plurality of posts, each of the posts extending lengthwise along a post axis between a first end and a second end, each of the posts comprising at least one hole that extends through the post generally intermediate the first and second ends, the hole defining a hole axis that is generally coplanar with and generally orthogonal to the post axis;

a plurality of first links, each of the first links comprising a first end, a second end spaced apart from the first end along a first link axis, and a first link web joining the first and second ends; and a plurality of fasteners, and once assembled, each of the fasteners extends through the hole of a respective one of the posts and couples the first end of a first one of the first links to the second end of a second one of the first links to secure the links to the post, wherein each of the fasteners applies a clamping force that urges the second end of the second one of the first links towards the respective post to bear against the first end of the first one of the first links, wherein the first end of the first one of the first links comprises an inner surface for abutting the post, wherein an outer side of the first end of the first one of the first links comprises a convex clamping surface, and an inner side of the second end of the second one of the first links comprises a concave clamping surface for complementary engagement with the convex clamping surface; and a plurality of second links, each of the second links comprising a first end, a second end spaced apart from the first end along a second link axis, and a second link web joining the first and second ends, wherein, once assembled, each of the fasteners extends through the hole of a respective one of the posts and couples the first ends of first ones of the first and second links to the second ends of second ones of the first and second links thereby securing the links to the post, wherein each of the fasteners applies a clamping force that urges the second ends of the second ones of the first and second links towards the respective post to opposingly bear against the first ends of the first ones of the first and second links, wherein the first end of the first one of the second links comprises an inner surface for abutting the post, and wherein an outer side of the first end of the first one of the second links comprises a convex clamping surface, and an inner side of the second end of the second one of the second links comprises a concave clamping surface for complementary engagement with the convex clamping surface.

4. The fence system of claim 3, wherein the second end of the second one of the first links envelops the first end of the first respective one of the first links.

5. The fence system of claim 4, wherein the first end of the first one of the first links comprises a slot, the second end of the second one of the first links comprises a pin boss for receiving the respective fastener, and the slot provides clearance for passage of the pin boss to the hole of the post.

6. The fence system of claim 5, wherein the respective fastener comprises a thread forming screw, and the pin boss comprises a bore that is sized for engagement with the screw.

7. The fence system of claim 6, wherein the second end of the second one of the first links comprises a contact relief area arranged generally between the pin boss and the concave clamping surface.

8. The fence system of claim 3, wherein the second end of the second one of the second links envelops the first end of the first one of the second links.

9. The fence system of claim 8, wherein the first end of the first one of the second links comprises a slot, the second end of the second one of the second links comprises a pin boss for receiving the respective fastener, and the slot provides clearance for passage of the pin boss to the hole of the post.

10. The fence system of claim 9, wherein an inner end of the pin boss of the second end of the second one of the second links is spaced apart from an inner end of the pin boss of the second end of the second one of the first links to define a gap therebetween.

11. The fence system of claim 10, wherein the respective fastener comprises a screw, and the pin boss comprises a through bore that is sized for clearance of the screw.

12. The fence system of claim 11, wherein the respective fastener comprises a disk spring, and the second end of the second respective one of the second links comprises a recess for seating the disk spring.

13. The fence system of claim 12, wherein the second end of the second respective one of the second links comprises a contact relief area arranged generally between the pin boss and the concave clamping surface.

14. The fence system of claim 3, further comprising a plurality of first end caps, wherein, for each of the first end caps, once assembled, the respective one of the fasteners applies a clamping force that urges the first end cap towards a respective one of the posts to bear against the first end of a respective one of the first links.

15. The fence system of claim 14, wherein each of the first end caps comprises a concave clamping surface for complementary engagement with a convex clamping surface of the first end of the respective one of the first links.

16. The fence system of claim 3, further comprising a plurality of first and second end caps, wherein, for each pair of the first and second end caps, once assembled, the respective one of the fasteners applies a clamping force that urges the first and second end caps towards a respective one of the posts to opposingly bear against the first ends of respective ones of the first and second links.

17. The fence system of claim 16, wherein each of the first and second end caps comprises a concave clamping surface for complementary engagement with respective convex clamping surfaces of the first ends of the respective ones of the first and second links.

18. The fence system of claim 3, further comprising a plurality of pivot balls, wherein, once assembled, each of the pivot balls comprises a central bore that receives a respective one of the posts, and a lateral bore that is aligned in registration with the hole, and the respective one of the fasteners applies a clamping force that urges the second end of a respective one of the first links towards the respective one of the posts to bear against the pivot ball.

19. The fence system of claim 3, further comprising a plurality of stakes, each of the stakes comprising a blade for penetrating a ground surface, and a receptacle for securing the first end of a respective one of the posts.

* * * * *